US011732903B2

(12) United States Patent
Martire

(10) Patent No.: US 11,732,903 B2
(45) Date of Patent: Aug. 22, 2023

(54) OVERFLOW PREVENTER

(71) Applicant: Louis Martire, Brooklyn, NY (US)

(72) Inventor: Louis Martire, Brooklyn, NY (US)

( * ) Notice: Subject to any disclaimer, the term of this patent is extended or adjusted under 35 U.S.C. 154(b) by 320 days.

(21) Appl. No.: 17/207,630

(22) Filed: Mar. 20, 2021

(65) Prior Publication Data

US 2021/0207817 A1 Jul. 8, 2021

Related U.S. Application Data

(62) Division of application No. 16/032,116, filed on Jul. 11, 2018, now Pat. No. 10,955,143, which is a division of application No. 15/271,061, filed on Sep. 20, 2016, now Pat. No. 10,718,531.

(51) Int. Cl.
*G08B 21/20* (2006.01)
*F24D 19/10* (2006.01)

(52) U.S. Cl.
CPC ..... *F24D 19/1009* (2013.01); *F24D 19/1015* (2013.01); *G08B 21/20* (2013.01); *F24D 2220/046* (2013.01)

(58) Field of Classification Search
CPC . G08B 21/20; F24D 19/1009; F24D 19/1015; F24D 2220/046; F16K 31/18
USPC ..... 237/8 A
See application file for complete search history.

(56) References Cited

U.S. PATENT DOCUMENTS 1,316,167 A * 9/1919 Lecrone ..... B67D 1/1238 141/94
3,575,020 A * 4/1971 Hubbard ..... D06F 13/00 68/4
7,191,649 B1 * 3/2007 Coogle ..... G01F 23/74 73/313
8,590,559 B1 * 11/2013 Gutierrez ..... G01M 3/16 200/61.04
9,105,175 B1 * 8/2015 Cantolino ..... F24H 9/16

* cited by examiner

*Primary Examiner* — Steven B McAllister
*Assistant Examiner* — John E Bargero
(74) *Attorney, Agent, or Firm* — Law Offices of Leo Mikityanskiy, P.C.; Leonid Mikityanskiy

(57) ABSTRACT

A residential and commercial hot water and steam boiler safety system and device that includes at least one hollow pipe, with one plugged or sealed end and a fitting on the other end for connecting the pipe in a substantially vertical mounting position, and at least one two float switch disposed in the pipe and electrically connected in series with a limit switch in the boiler, where the pipe is adopted for the flow and accumulation of water, so that float switch activates as the pipe fills with water and shuts off the boiler by turning off the gas valve, promoting safer boiler and steam boiler operation. Additional float switches positioned above or below in the hollow pipe may provide additional functions, such as a warning light and sound to the owner, or a notification via a telephone or cell phone system or through the home network or Wi-Fi system.

20 Claims, 16 Drawing Sheets

1–2 NORMALLY CLOSED CONTACTS TO LIMITS (IN SERIES WITH LIMITS)
3–4 NORMALLY OPEN CONTACTS IN SERIES WITH SOLENOID VALVE/ALARM
5–6 RELAY COIL TERMINALS
7–8 LIMITS
9–10 FLOAT SWITCH
11 24 VOLT HOT
12–13 SOLENOID VALVE/ALARM
14 24 VOLT NEUTRAL

OVERFLOW PREVENTER

THE FIELD OF INVENTION

The system, device and method of the present invention relate to a device, system and method for improving the safety of residential and commercial hot water and steam boilers, primarily those burning natural gas, commonly used for heating, hot water, and other purposes, and for all other water and steam boilers using combustible liquids and fuels, such as oil and liquefied gas. Hot water and water heated to steam have many residential and commercial uses. Hot water and steam are used for cooking, cleaning, bathing, and space heating, to name just a few.

BACKGROUND OF THE INVENTION

Natural gas has been used for hot water and heating for a very long time in the United States. When natural gas is mixed with air in the right proportions, the air of course containing oxygen necessary for burning, natural gas is a clean-burning, efficient, and safe way for hot water and heating purposes. Hot water and heat account for a large portion of the residential energy bill because, according to the U.S. Department of Energy statistics, 14% of the home energy usage is for heating water and 44% is for heating and air conditioning. Thus, the system, device, and method of the present invention have the tremendous potential to improve the safety of the water and heating systems of millions of households.

Numerous devices and systems exist to use the natural gas for hot water and heating. The devices that burn fuel to provide hot water or steam are commonly referred to as water heaters, hot water heaters, hot water tanks, boilers, steam boilers, heat exchangers, and other names known in the art. Some of these devices use electric power instead of fossil fuels, with the possibility of all or some of the electricity being provided by solar power or other renewable energy source. Indeed, a very large industry exists to manufacture, distribute, and service the boilers and steam boilers using natural gas.

The devices and systems using natural gas are constantly improved to increase their safety and efficiency. However, such improvements are usually directed as the devices and systems themselves (i.e., to prevent fires and gas explosions, which are dangerous to the life and safety of individuals using these devices, and are also dangerous to the property. However, no device or method exists to improve the safety of the boilers and steam boilers in terms of water leakage, dripping, and water and steam explosions, either one of which can flood a basement, causing massive damage to the basement and anything in it, further causing secondary damage from mold, short circuits, fires and other issued caused by flooding.

Indeed, natural gas boilers and steam boilers typically have a pressure and/or temperature sensor or sensors. The sensors are sometimes adjustable and sometimes preprogrammed to a certain limit of safe pressure and/or temperature. If the safe pressure and/or temperature is exceeded, a limit switch will typically end the operation of the boiler or heating system by shutting off the gas valve and/or the burner.

The limit stitches are used on both residential and commercial boiler and heating systems. The limit switches are essentially water temperature and/or pressure controllers, which shut off the gas valve or otherwise turn off the operation of a water or steam boiler, used for hot water or heat. A limit switch is typically an electromechanical device that consists of an actuator mechanically linked to a set of contacts. When an object comes into contact with the actuator, the device operates the contacts to make or break an electrical connection. The boiler temperature control usually has an adjustable temperature sensing for limit control to address different applications. The limit switch can be made to open on temperature rise and/or open or close on temperature fall. For example, a Single Acting Boiler Temperature Control will incorporate a high limit function that acts like an on/off switch. The high limit setting is the maximum temperature the boiler can attain. When the high limit point is reached, the switch turns off the burner. There are numerous other types of limit switches, having double limit controls, differential controls, and the like, but the system, device and method of the present invention works with all types of limit switches equally well, without regard to the actual limiting method used.

What is needed is a system, device and method that can be used in residential and commercial boiler and heating systems, improving the safety of these system by shutting them down if the pressure relief valve is leaking and notifying the owner of the problem.

The present invention solves this problem by providing a system, device and method for disconnecting the gas valve or the burner and notifying the owner of the leak, caused by excessive pressure or temperature of the heating system or boiler.

SUMMARY OF THE INVENTION

It is an object of the present invention to provide a system, device and method to improve the safety of heating systems and boilers. The present invention (Overflow Preventer) is an inexpensive to manufacture, easy to install, commercial and residential safety device for heating systems and boilers burning natural gas and liquid/solid fuels (i.e., all combustible gases and liquids). The present invention may be used for applications of varying scope, such as a single residential boiler (small) to industrial applications such as a building or factory heating system (large).

The preferred embodiment of the present invention achieves this goal with a system, device and method that includes at least one hollow pipe, with one plugged end and a fitting on the opposite end for connecting the pipe to the pressure relief valve, and at least one water-activated switch, disposed inside the hollow pipe. This water-activated switch is preferably a float switch, but it may be an air pressure switch activated when sufficient pressure builds up inside the device after the water accumulates. The pipe is preferably mounted in a substantially vertical configuration and is adopted to be filled with water from leaking pressure relief valve, so that the switch is activated when the pipe fills with water and shuts off the heating system or boiler by being wired in series with a limit switch of the heating system or boiler. Additionally, the same water-activated switch may activate the visual and/or audible alarm for the owner that there is an issue. Alternatively, there may be two separate switches disposed in the hollow pipe, one activating the alarm for the owner and one deactivating the heating system or boiler.

During the operation of a Hot Water Generator (also called a hot water boiler), a steam boiler or a hot water tank, if the pressure exceeds the rated relief pressure of the pressure relief valve (or the working pressure of the system) the spillage will enter the Overflow Preventer. As soon as the Overflow Preventer senses the spilled water (by the float switch) from a hot water boiler or hot water tank, or the condensed water from the steam exiting the pressure relief valve on a steam boiler, the Overflow Preventer shuts the Hot Water Generator down to prevent further pressure build up that may present a danger to life and/or property, and to prevent the massive water spill that will result if the system continues to run unchecked.

Also, the city water supply to the unit may be shut off by the solenoid valve in addition to shutting down the Hot Water Generator. The solenoid valve is located remotely from, but is electrically wired into the system and device of the present invention. On a steam system, a stand-alone or redundant Overflow Preventer may be configured high enough on the return line in order to stop inadvertent overfilling of the system.

The general operation of the Overflow Preventer is as follows:

(a) due to over pressurizing or over filling, water from a hot water boiler, hot water tank or from the return line on a steam system, or condensed steam (water) from the pressure relief valve on a steam boiler, enters the Overflow Preventer;

(b) in the Overflow Preventer, the float rises to close the float switch;

(c) when the float switch closes, the relay coil is energized;

(d) when the relay is energized, the normally closed pair of contacts, that are in series with the limits in the case of a boiler and in series with the flame sensor (thermocouple) in the case of a hot water tank, open to shut the boiler or tank down;

(e) at the same time that the normally closed pair of contacts open, the normally open pair of contacts close to activate the solenoid valve and/or alarm and/or lamp;

(f) when the solenoid valve is activated, it closes the feeder line to the boiler or the cold water supply on the hot water tank; and (g) once the system had been inspected and repaired, the overflow preventer resets after the water that was trapped inside it to raise the float, had been drained.

The air vent allows for full water flow throughout the respective water ways in the overflow preventer and on the tapped return line on a steam system. The relay, which houses the coil, normally closed and normally open contacts and the electrical terminals for the internal factory connections are located on the printed circuit board. The junction block, on the outside of the overflow preventer, provides the terminals for the external field wiring.

This design of the preferred embodiment is simple and elegant, having a compact size and being inexpensive to manufacture and simple to install, providing maximum safety and economic benefit for a minimal investment of labor and materials. The system and device are easy to assemble, and the method is easy to follow according to the disclosure of the present application. No special skills are required, so this invention is usable by anyone. The assembly for users can be conducted at the factor assembling the heating system or boiler, or at the location the heating system or boiler is installed, at any time before or during the exploitation.

Many configurations may be used for the system, device and method of the present invention within the spirit and scope of the present invention. Although the examples and the preferred embodiments are shown primarily with natural gas boilers and heating systems, the system, device and method of the present invention are equally applicable to liquid and solid fuels (combustible liquids and solids). The anticipated service life of the embodiments of the present invention is at least five years.

BRIEF DESCRIPTION OF THE DRAWINGS

A system, device and method to improve the safety of natural gas burning heating systems, boilers and steam boilers of the present invention will now be described by way of example with reference to the accompanying drawings in which.

DESCRIPTION OF THE PREFERRED EMBODIMENT

Figure 2:
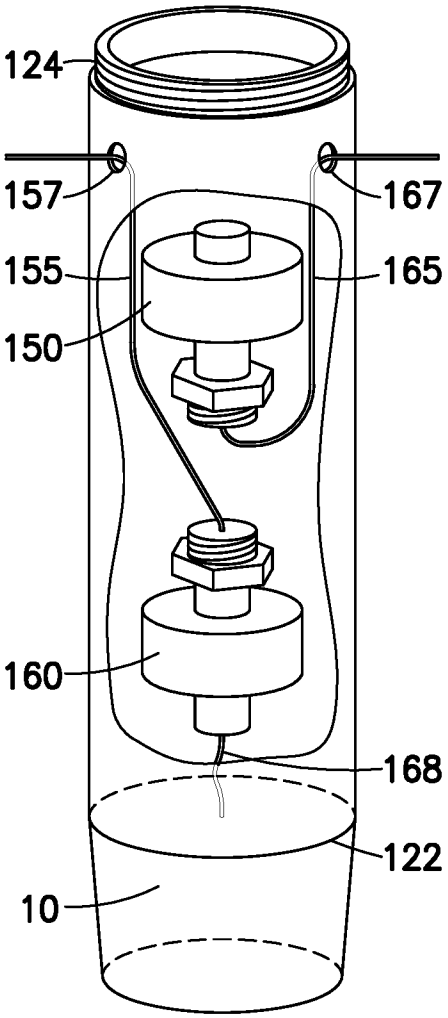
FIG. 2 is a perspective view of the device of FIG. with a hollow pipe, having a fitting or threading on the top end and a closed or plugged bottom end for the accumulation of water from the pressure relief valve and the activation of two float switches positioned in the hollow pipe, where the bottom end of the hollow pipe is plugged by the alarm module.

Boiler pressure relief valve (commonly called blow off valve) is a safety valve that protects the heating system or a boiler from building up to much pressure and possibly blowing up. Sometimes the relief valve or blow off valve will leak. The leaks may be called by a number of reasons, two of which are excessive water pressure or excessive operating temperature, generating steam and, once again, excessive pressure on the system.

The boiler pressure typically varies from 12 psi to 18 psi (12 psi for a boiler and 15 psi for a steam boiler for example). The temperature should typically be between 160 and 180 degrees F. The pressure relief valve for a regular water boiler is set to only allow 12 psi in the boiler. If this valve fails, it will allow the pressure in the boiler to reach 30 psi or higher, causing the relief valve to leak. If the pressure goes over 30 psi and the relief valve does not leak, it may cause a very dangerous situation from overpressure, such as an exploding boiler, exploding pipes, blown off water expansion tank, or blown off relief valve (separated from the boiler). Needless to say, either of these could be hazardous to life and health of any individual in the immediate vicinity due to the explosion and hot water, and it could cause severe water damage from the leaking water.

Temperatures of the heating system or boiler that elevates above the safe operating temperature can also cause the buildup of steam and pressure and an explosion or water leak. The standard recommendation when a pressure relief valve is leaking is to turn off the boiler and to call a specialist to address the problem. However, the owner of the heating system of boiler must be aware of the problem and must be present to do so. If the owner does not see or hear the leaking pressure relief valve somewhere in the basement, or if the owner is simply not home when this happens, the results can be disastrous. The system, device and method of the present invention address these issues of notifying the owner of the problem, as well as improve the general safety of the heating and boiler systems.

Pressure relief valves come in a number of standard sizes known in the art, such as ¾" and ½" valves. The system, device, and method of the present invention can be adopted by those skilled in the art to accommodate all sizes of the pressure relief valves. The pressure relief valves are typically made from bronze, cast iron, stainless steel, and other corrosion-resistant metals that can withstand the specified pressure. The pressure relief valves usually have threading on the ends so that additional pipes may be connected by cooperating male-female connectors.

Figure 1:
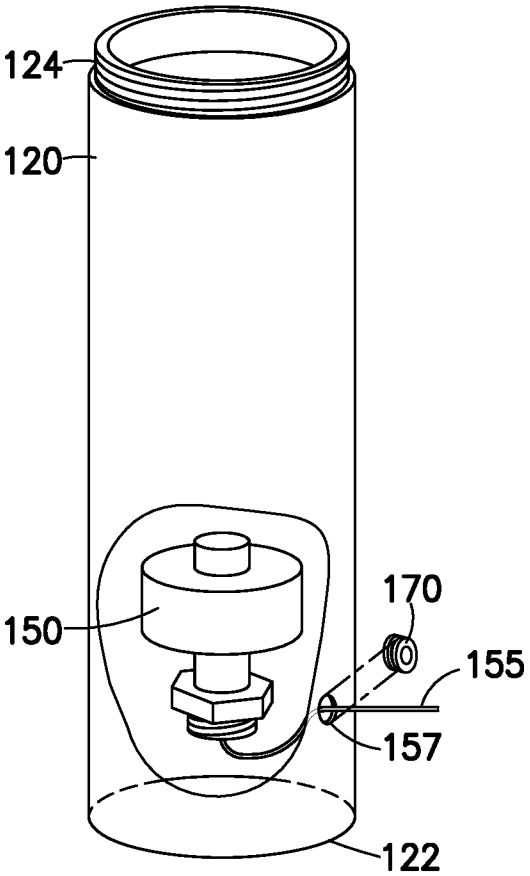
FIG. 1 is a perspective view of the device to improve the safety of heating systems, boilers and steam boilers of the present invention with a hollow pipe, having a fitting or threading on the top end and a closed or plugged bottom end for the accumulation of water from the pressure relief valve and the activation of a float switch positioned in the hollow pipe.

A novel system, device and method to improve the safety of natural gas burning boilers and steam boilers are provided. With reference to FIGS. 1-2, one preferred embodiment of the present invention achieves this goal with a housing in the form of a hollow pipe 120, which is designed for substantially vertical mounting and has a bottom end 122, which is capped or plugged (i.e., does not let water through) or substantially closed (i.e., allow some water through but permits the accumulation of water in the hollow pipe 120), and an open or substantially open top end 124 which is treaded for attaching the housing to the pressure relief valve of a boiler. The hollow pipe 120 is preferably made of copper or other suitable, corrosion-resistant material such as those disclosed herein, and the preferred diameter hollow pipe 120 is one inch (1"), but it could be ¾" to match the standard diameter of the pressure relief valves. Alternatively, the hollow pipe 120 may be 1" but use a ¾" adaptor to connect to the pressure relief valve. It should be noted that although a hollow pipe 120 is the preferred shape of the housing, the housing may be of any other shape or size with an internal cavity. Other attachment means known in the art may be used to connect the open top end 124 to the pressure relief valve of a boiler, including collars, nuts and bolts, screws, pins, clamps, reciprocal connectors, and other methods known in the art.

There is at least one float switch 150 disposed, positioned or mounted inside the hollow pipe 120. The height of the mounting of the float switch 150 inside the hollow pipe 120 determines how early the switch is activated. Although the float switch 150 may be permanently or semi-permanently mounted, it is preferably mounted in a semi-permanent (detachable) way, so that the float switch 150 may be easily replaced. Additionally, the position of the float switch 150 inside the hollow pipe 120 may be adjustable, so that the user or the installer may vary how soon the switch is activated by selectively installing the float switch 150 higher or lower inside the hollow pipe 120.

The float switch 150 is electrically connected to one of the limit switches of the boiler, as illustrated in FIG. 1, such as by water-resistant or waterproof electrical wiring 155 that passes through an aperture 157 in the hollow pipe 120 to reach the limit switch circuit. It should be noted that the aperture 157 should be positioned above the float switch 150 to ensure that the water does not leak out or drip before reaching the float switch 150, as illustrated in FIG. 2, or alternatively, the aperture 157 may be sealed by a sealant such as silicone or other sealants known in the art, or the electrical wiring 155 may pass through a rubber or silicone grommet 170 of a cooperating size with the aperture 157 as illustrated in FIG. 1, so that the aperture 157 is sufficiently water-tight.

Figure 8:
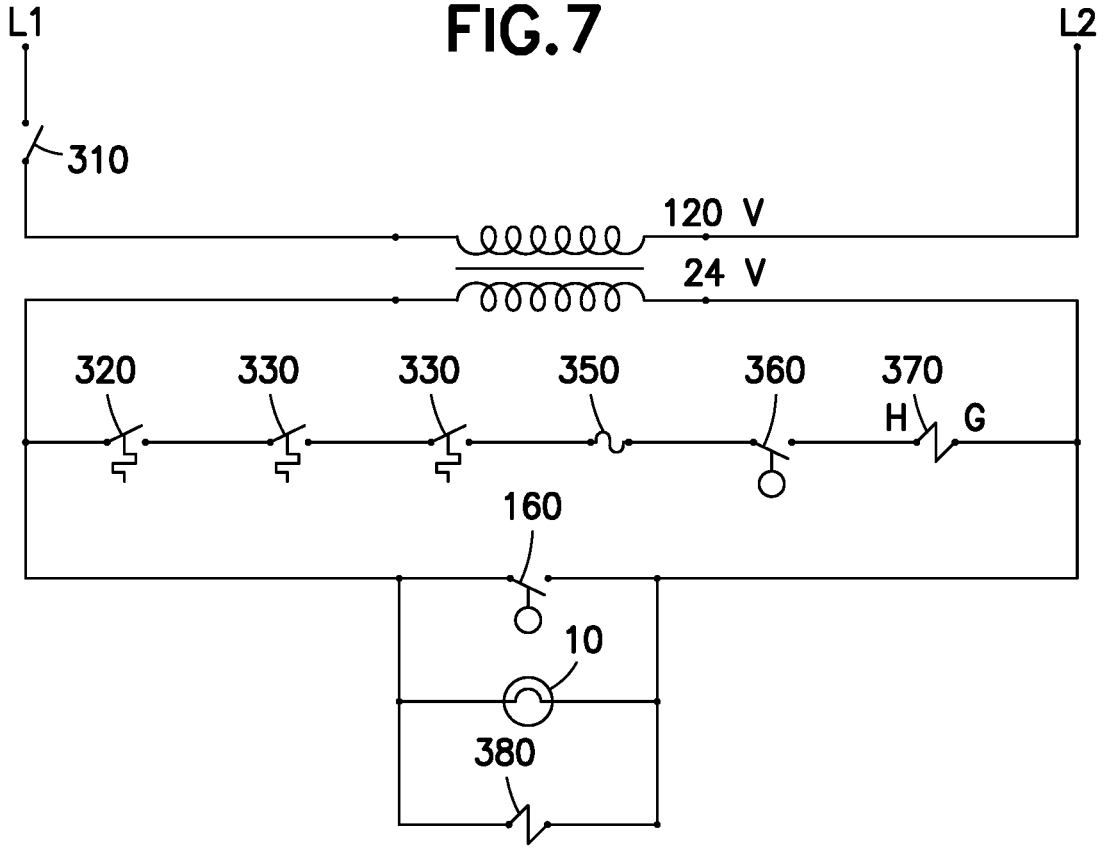
FIG. 8 is a circuit diagram if the electrical circuit of the device and system of the present invention.
Figure 11:
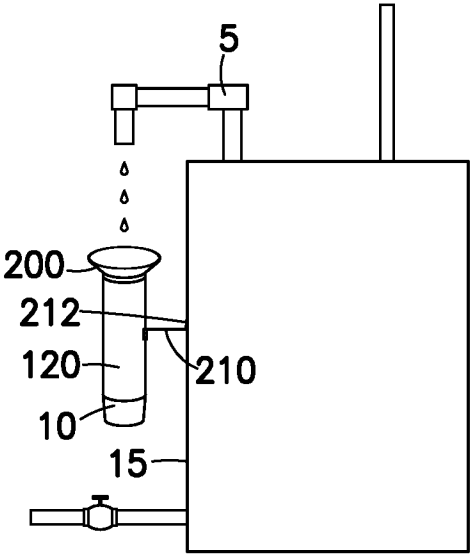
FIG. 11 is a side view of the mounting of the alternative embodiment of the present invention illustrated in FIG. 5.
Figure 10:
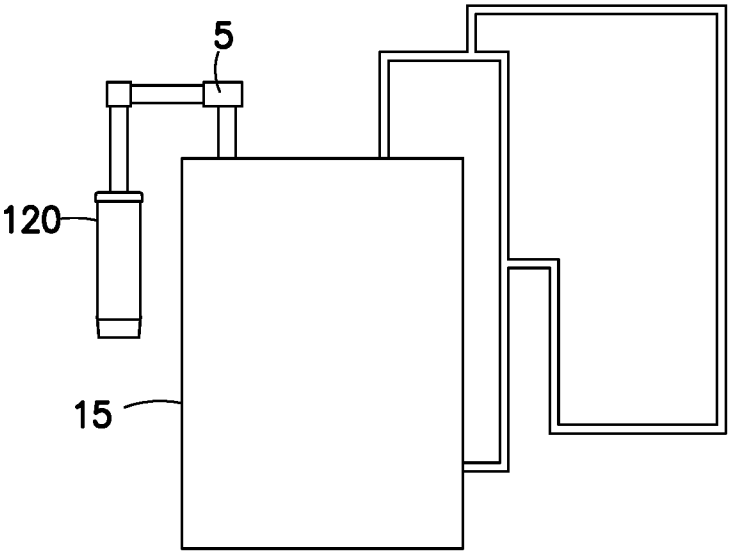
FIG. 10 is a side view of the attachment of the device of FIG. 2 to a pressure relief valve mounted on top of the steam boiler.
Figure 9:
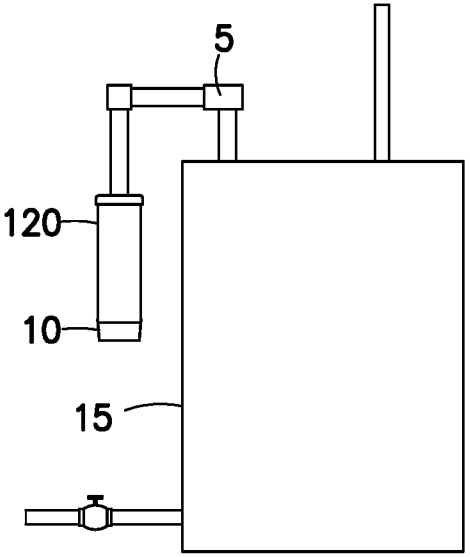
FIG. 9 is a side view of the attachment of the device of FIG. 1 to a pressure relief valve mounted on top of the boiler.
Figure 13:
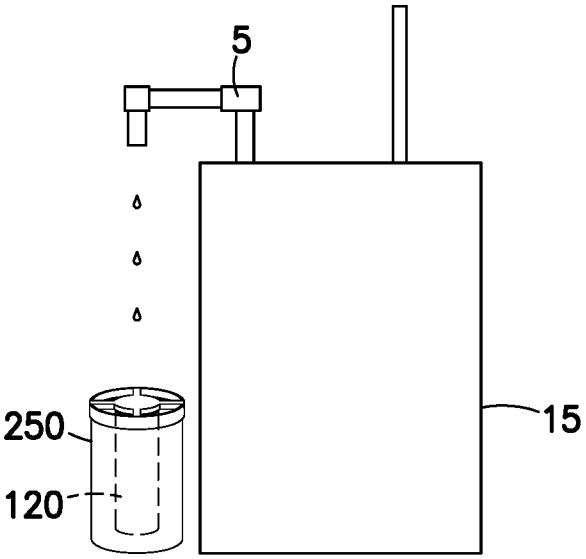
FIG. 13 is a side view of the positioning of the system and device of the present invention illustrated in FIG. 6.

In operation, the open top end 124 is threaded into the pressure relief valve 5 as illustrated in FIGS. 9-10 so that the hollow pipe 120 is substantially vertical. The water leaking or dripping from the pressure relief valve 5 will eventually reach the level of the float switch 150, which will activate and open or close the electrical circuit of the limit switch and thus will shut off the boiler 15 (preferably by shutting off the gas valve solenoid 370 or 380 illustrated in FIG. 8) when the water level reaches the float switch 150 and activates it. Thus, the user or the installer may vary the amount of water that leaks or drips from the pressure relief valve 5 before the float switch 150 is activated and the boiler is shut off. Various mounting means for the float switch 150 are envisioned, such as threading, rails, screws, bolts, pins, and other connectors known in the art.

Figure 3:
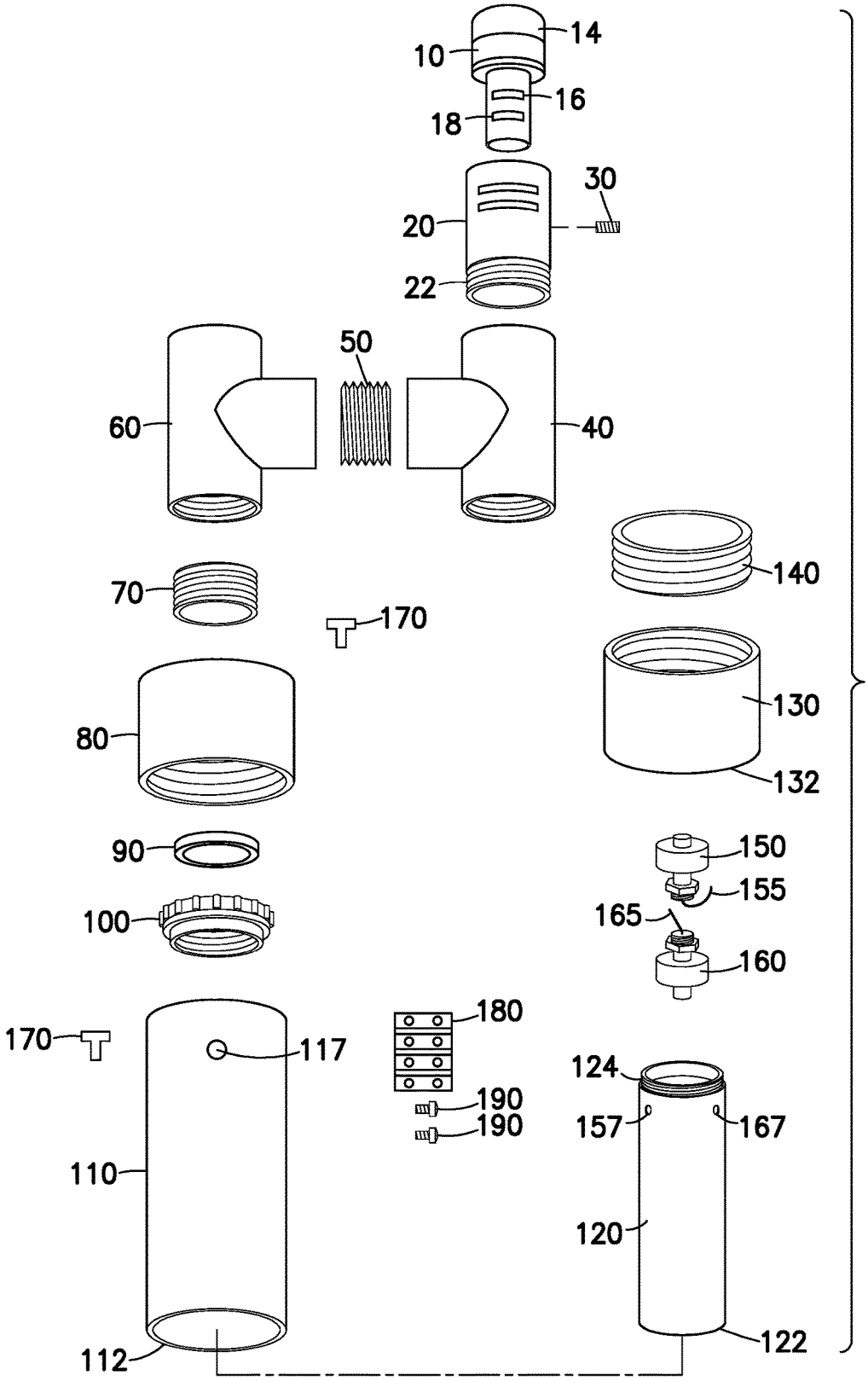
FIG. 3 is a perspective exploded view of an alternative embodiment of the system of the present invention, including a hollow pipe in a housing with a closed bottom end for the accumulation of water from the pressure relief valve and the activation of float switches positioned in the hollow pipe, and an alarm module held in the alarm module housing connected by tees and other parts to complete the system.
Figure 4:
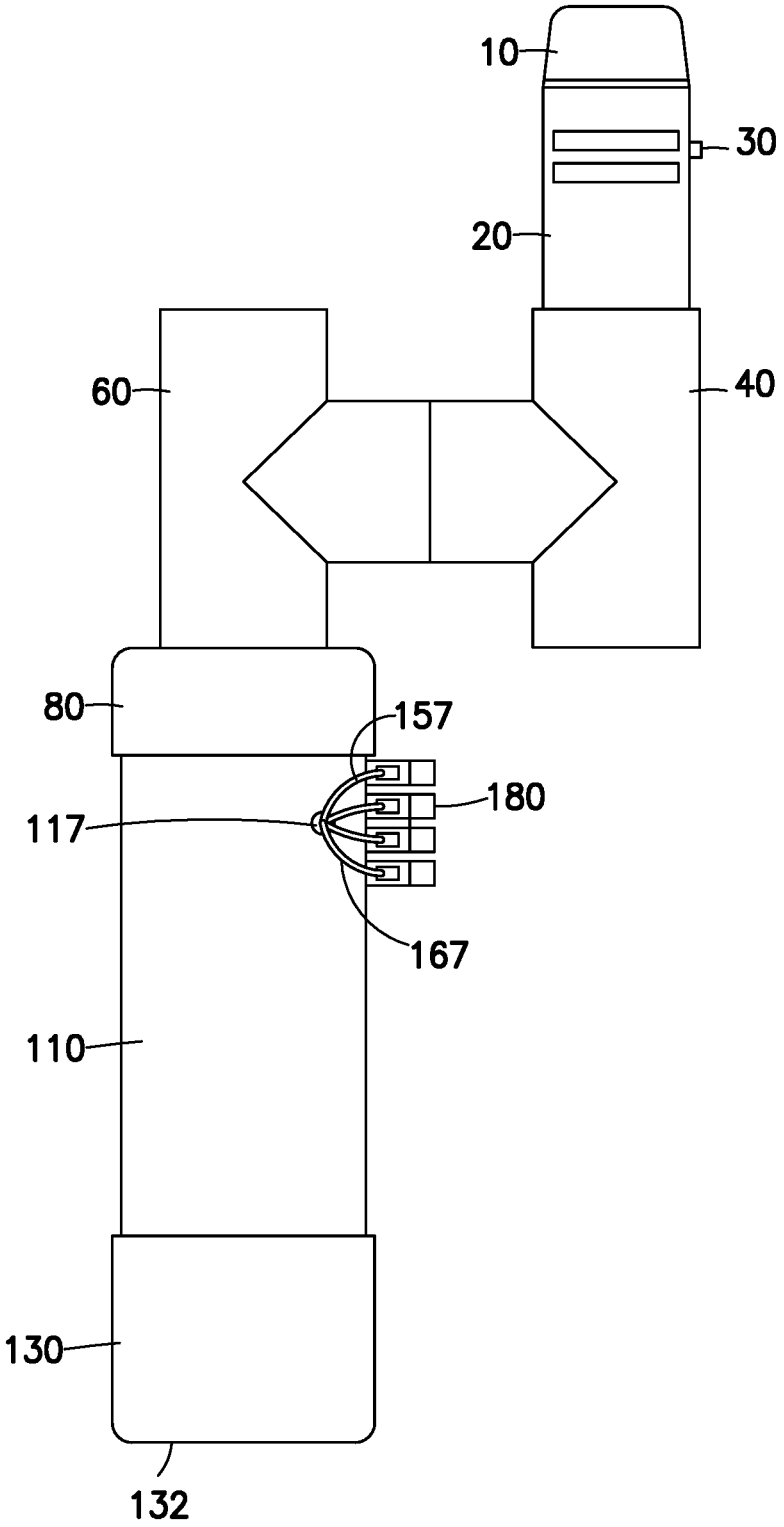
FIG. 4 is a side view of the fully assembled alternative embodiment illustrated in FIG. 3.
Figure 7:
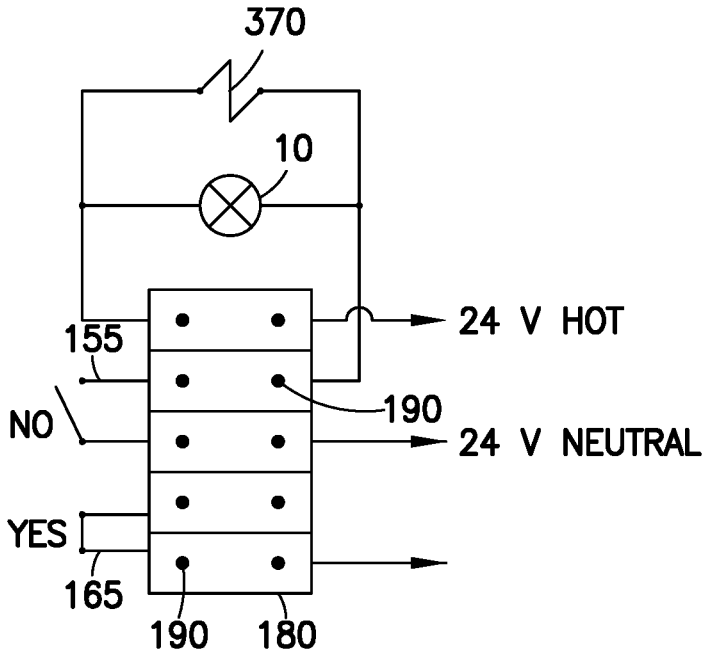
FIG. 7 is a circuit diagram view of the terminal block connecting the electrical wiring from the float switches to limit switches.

In another modification of this preferred embodiment illustrated in FIG. 2, there are two float switches 150 and 160 disposed inside the hollow pipe 120. The float switches 150 and 160 are electrically connected to one of the limit switches of the boiler, as illustrated in FIG. 2, such as by water-resistant or waterproof electrical wiring 155 and 165. The electrical wiring passes through apertures 157 and 167 in the hollow pipe 120 respectively, but, of course, a single aperture (for example aperture 157) may be used for both sets of electrical wiring 155 and 165. In operation, the bottom float switch 160 may give an early visual and/or audible warning to the operator or owner of the boiler by being electrically connected to the alarm module 10 through electrical wiring 168 (direct connection). Alternatively, the alarm module 10 may be connected to the float switch 160 through the terminal block 180 as illustrated in FIGS. 7-8. The alarm module 10 preferably contains an audio alarm or buzzer and a lamp or light warning signal as illustrated in FIGS. 3-4, but can contain just one of those devices. The alarm module may be detachably or permanently mounted into the bottom end 122 of the hollow pipe 120 by threaded or other connectors (essentially, the alarm module 10 then becomes the plug of the bottom end 122, which prevents the water from leaking out from the hollow pipe 120). Then, if the audio and/or visual warning activated by the float switch 160 is not heard or heeded, the float switch 150 deactivates the boiler when the water level rises above the float switch 160 and to the float switch 150, by opening or closing the electrical circuit the limit switch that shuts off the gas valve. The alarm module 10 may have an internal power source, such as a battery, or it may be externally powered by electrical wiring.

Another preferred embodiment of the present invention is shown in FIGS. 3-4, which are the exploded and fully assembled views of this embodiment respectively. With reference to FIG. 3, the system and device of the present invention are made from a hollow pipe 120, which is designed for substantially vertical mounting and has a bottom end 122, and an open top end 124. The hollow pipe 120 is preferably made of copper or other suitable, corrosion-resistant material such as those disclosed herein, and the preferred diameter hollow pipe 120 is one inch (1") or 1½. The bottom end 122 does not need to be capped or plugged in this embodiment because the hollow pipe 120 is housed inside a housing 110, which may be made from Chlorinated Polyvinyl Chloride (CPVC), stainless steel, cast iron, copper or any other suitable material as disclosed herein. The diameter of the housing 110 is preferably 1½", but at least sufficient to accommodate the diameter and length of the hollow pipe 120 and the easy insertion and removal of the hollow pipe 120 into the housing 110. The housing 110 has the bottom end 112, which is capped with a female adapter 130, having a closed or plugged bottom end 132. The female adapter 130 is connected to the bottom end 112 of the housing 110 by the close nipple 140. The capped female adapter 130 ensures that the water leaking or dripping from the pressure relief valve accumulates inside the housing 110, filling the hollow pipe 120 and triggering the float switches 150 and 160. The female adapter 130 and the close nipple 140 are preferably CPVC, and both are preferably of 1½" in diameter.

The float switches 150 and 160 are connected to the limit switch and/or the alarm module 10 by electrical wiring 155 and 165 respectively, which passes through apertures 157 and 167 in the hollow pipe 120 respectively and come out of the aperture 117 in the housing 110. The wiring 155 and 165 is connected to the terminal block 180, which uses terminal block screws 190 to secure, connect and disconnect the wiring. The electrical connections to and from the terminal block 180 are illustrated in FIG. 7, where a gas valve shutoff solenoid 370 is connected in series with the float switch 150 and connected in parallel with the alarm module 10. The wiring 165 (closed circuit) illustrates that the float switch 160 was activated, but the open circuit of the wiring 155 illustrates that the float switch 150 has not yet been activated, and the electric wiring 175 sends the close the valve command by opening or closing the electrical circuit of the limit switch or switches from the terminal block 180 by electrical wiring 175.

The entire electrical circuit, including limit switch, float switch, alarm, and gas valve shut off is illustrated in FIG. 8, where the single-pole, single-throw SPST switch 310 turns on the 120 V power, which is converted to 24 V to power the circuit including a THST 320, an aquastat water temperature controller 330, a blocked vent switch 340, a flame roll out switch 350, a low water cut off switch 360, and a gas valve shutoff solenoid 370 in series with the float switch 150. There may be another float switch 160 connected in parallel with the alarm module 10 and a shut off valve solenoid 380.

The housing 110 is connected to a cap 80, which may be made from the same or a different material than the housing 110 a locknut 100, having a washer 90 between the locknut 100 and the cap 80. The locknut 100 is preferably a ¾" diameter brass, and the washer 90 is preferably rubber, but other suitable materials may be used. the cap is preferably the same diameter and the housing 110 (i.e., 1½"), The cap 80 is connected to an in-line arm of the threaded Tee 60 by the means of a threaded close nipple 70, which is preferably ¾" diameter brass. The threaded Tee 60 is preferably a ¾" diameter CPVC, and the transverse arm of the treaded Tee 60 it is connected to the transverse arm of another threaded Tee 40 by a threaded close nipple 50, which is also preferably ¾" diameter brass. The threaded Tee 40 is also preferably a ¾ diameter CPVC. There is an alarm module housing 20 connected to the threaded Tee 40 by the threaded bottom end 22 of the alarm module housing 20. The alarm module 10 is held in place in the alarm module housing 20 by the set screw 30. The alarm module 10 is electrically connected to one or more of the float switches 150 and 160, and the alarm module contains a light source, such as a lamp, LED, or strobe light 14, and/or a sound transducer 16 such as a speaker, piezo buzzer, or another type of audible alarm. The alarm module may also contain electrical, electronic, and/or communications circuitry 18 to communicate with the owner of the operator of the boiler that the water is leaking from the pressure relief valve when one or more of the float switches 150 and 160 are activated. The communications may be by connecting into the home network or Wi-Fi wireless signal, or by initiating a landline or cellular telephone call, email or text message.

The terminal block 180 is preferably attached to the housing 110 as illustrated in FIG. 4, which shows the fully-assembled embodiment of FIG. 3. As shown in FIG. 4, the system and device of the present invention connect to the pressure relief valve by the threaded connector in one of the in-line arms of this threaded Tee 60. The opposite in-line arm of the threaded Tee 60 is connected to the pressure relief valve of a boiler, preferably by using cooperating threading or other connection means. The threaded Tee 40 connected to the threaded Tee 60, the alarm module housing 20 and the alarm module 10 held by the set screw 30 are on a separate "branch" of the system and device, so they are not affected by the water leaking or dripping from the release valve into the threaded Tee 60, through the cap 80, and into the housing 110, where the water accumulates because the female adapter 130 caps the housing 110. The water fills the housing 110 and the hollow pipe 120, and triggers the float switches 150 and 160 illustrated in FIG. 3. The wiring 157 and 167, passing through the aperture 117 in the housing 110 enables the float switches 150 and 160 to open or close the electrical circuits of the limit switch or switches on the boiler.

Figure 12:
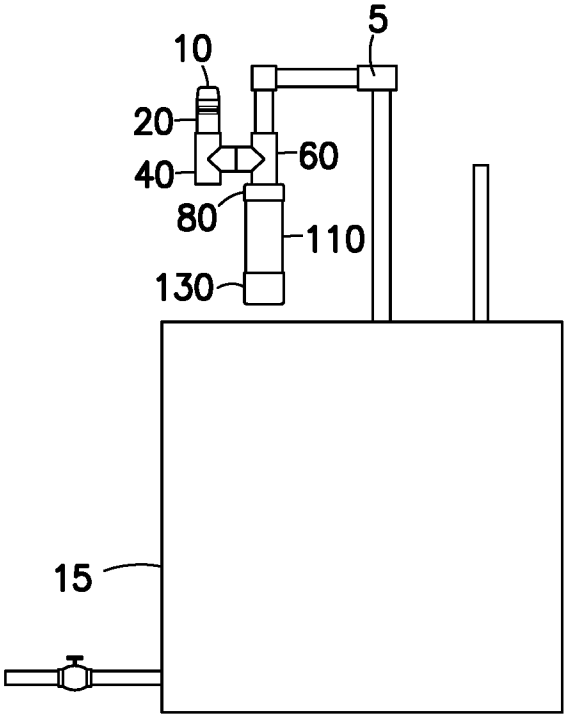
FIG. 12 is a side view of the mounting of the system and device of the present invention illustrated in FIGS. 3-4.

The particular embodiment illustrated in FIG. 3 is especially useful when it is necessary to clear the top of the boiler. As illustrated in FIG. 12, the pressure relief valve 5 is usually mounted on the top of the boiler 15. The connections of two Tees described with reference to FIG. 3 allows to mount the device and system of the present invention to the pressure relief valve, while avoiding interference from the top of the system and device (i.e., the alarm housing 20 and the alarm module 10 are on a separate branch, parallel to the main device, so they do not take up any vertical space). In this configuration, the housing 110 with the hollow pipe 120 and the float switches 150 and 160 would be suspended in the above the top of the boiler 15.

For occasions when various codes, such as city plumbing codes or local ordinances, do not permit attaching the system and device of the present invention directly to the pressure relief valve (for example, when it is prohibited to restrict or obstruct the water flow from the pressure relief valve), several other embodiments of the present invention are provided.

Figure 5:
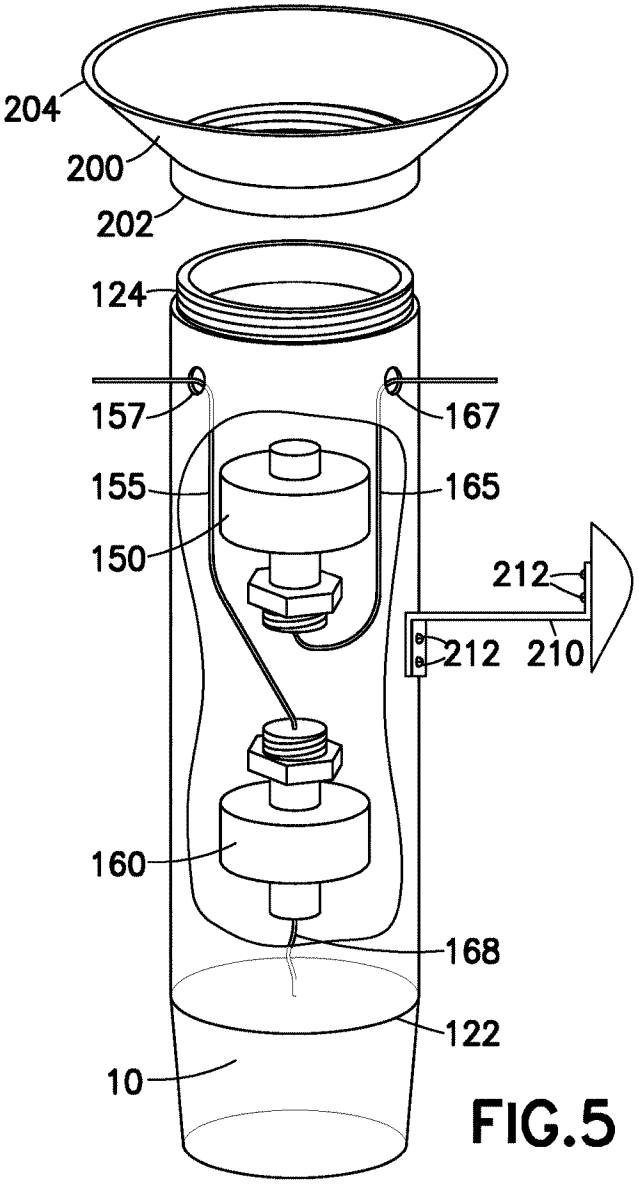
FIG. 5 is a perspective view of another alternative embodiment of the device of FIG. 1, also including a funnel for collecting water from the pressure relief valve and directing the water into the hollow pipe where the float switches are located, and also including a bracket for mounting the hollow pipe to the wall of the boiler.

One such embodiment is illustrated in FIG. 5. With reference to FIG. 5, the embodiment is as described herein with reference to FIGS. 1-2, but also including a funnel 200 having a wide top end 204 and a narrow bottom end 202, cooperating in size with the top end 124 of the hollow pipe 120, so that the funnel 200 may be used in conjunction with the hollow pipe 120. The narrow bottom end 202 of the funnel 200 is preferably threaded as a female threaded connector, to accept the male threaded top end 124 of the hollow pipe 120 (i.e., both the top end 124 and narrow bottom end 202 would have cooperating male/female threading, preferably of a standard ¾" or ½" size. This embodiment would also include a bracket 210 with screws or bolts 212, or other mounting means to connect the hollow pipe 120 to the side wall of the boiler. The size of the bracket 210 or other mounting means would be selected (or would be adjustable) to position the hollow pipe 120 substantially under the pressure relief valve during the installation. Thus, in operation, the hollow pipe 120 would have a funnel 200 screwed onto the top end 124 via the narrow bottom end 202, so that the funnel 200 would be collecting the water leaking or dripping from the pressure relief valve and directing the water into the hollow pipe 120 with one or more float switches 150 and/or 160. When the water reached the level of any given float switch, it would be activated, performing its function (i.e., signaling the alarm via a sound and/or visual indicator, contacting the owner/operator of the boiler, and/or shutting off the boiler).

Figure 6:
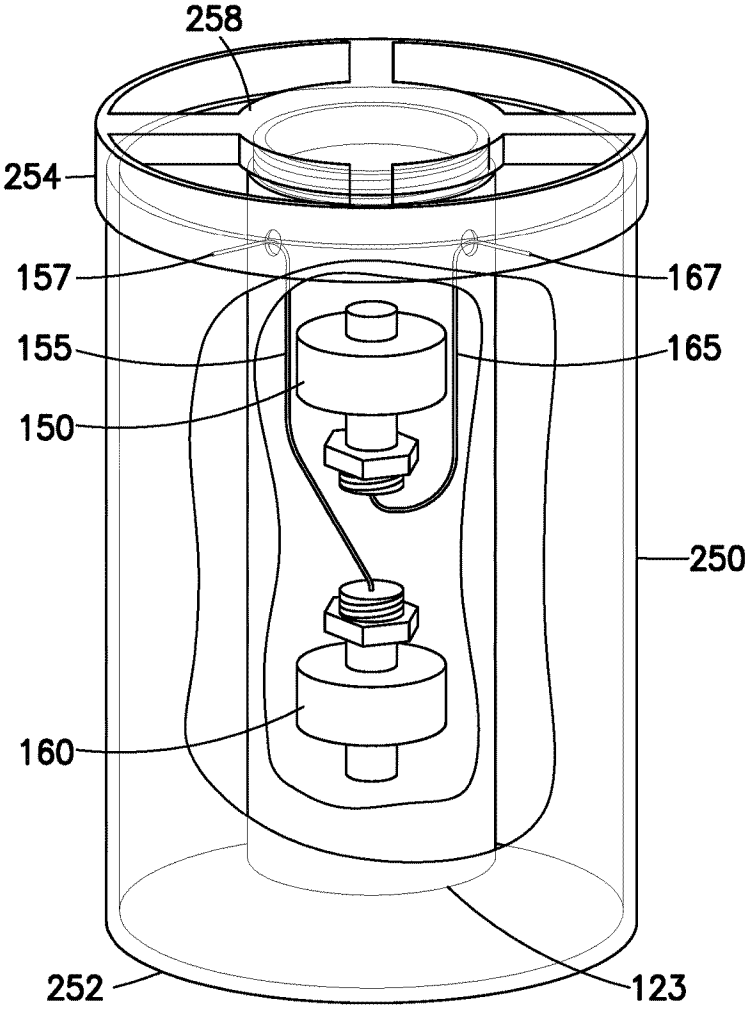
FIG. 6 is a perspective view of yet another alternative embodiment of the device of FIG. 2, also including a container for collecting water from the pressure relief valve and directing the water into the hollow pipe, where the float switches are located.

Yet another embodiment for when the system and device of the present invention cannot be connected directly to the pressure relief valve is illustrated in FIG. 6. With reference to FIG. 6, this embodiment of the present invention has a hollow pipe 120, which is designed for substantially vertical mounting and has an open bottom end 123 (i.e., which is not capped or plugged), and an open top end 124 which is treaded. The hollow pipe 120 is preferably made of copper or other suitable, corrosion-resistant material such as those disclosed herein and has the same preferred diameters as disclosed herein.

There is at least one float switch 150 disposed inside the hollow pipe 120, but preferably there is another float switch 160 as illustrated in FIG. 6. The height of the mounting of the float switch 150 inside the hollow pipe 120 determines how early the switch is activated. Although the float switch 150 may be permanently or semi-permanently mounted, it is preferably mounted in a semi-permanent (detachable) way, so that the float switch 150 may be easily replaced. Additionally, the position of the float switch 150 inside the hollow pipe 120 may be adjustable, so that the user or the installer may vary how soon the switch is activated by selectively installing the float switch 150 higher or lower inside the hollow pipe 120.

The float switch 150 is electrically connected to one of the limit switches of the boiler, as illustrated in FIG. 1, such as by water-resistant or waterproof electrical wiring 155 that passes through an aperture 157 in the hollow pipe 120 to reach the limit switch circuit.

The container 250 preferably has a bottom part 252, which is a regular container of any shape, preferably cylindrical, and a top part 254 that connects or attaches to the bottom part 252. The top part 254 has an attachment means 258 for the threaded top end 124 of the hollow pipe 120, so that the top part 254 may be taken off or disconnected from the bottom part 252, the top end 124 connected to the top part 254 by the attachment means 258, which are preferably reciprocal threading, and the top part 254 is then placed back onto or attached to the bottom part 252 so that the hollow pipe 120 is substantially vertical and disposed inside the container 250. The container 250 may be freestanding or it may be attached to the side wall of the boiler 15 under the pressure relief valve 5. Likewise, the hollow pipe 120 may be attached to or secured in the container 250 by using methods other than the treaded top end 124.

In operation, the container 250 is placed or mounted under the pressure relief valve 5, and the container 250 will collect the water leaking or dripping from the pressure relief valve 5. The water will fill up the container 250 and the hollow pipe 120 through the open bottom end 122 and eventually reach the level of the float switch 150, which will activate and open or close the electrical circuit of the limit switch as illustrated in FIGS. 7-8, and thus will shut off the boiler (preferably by shutting off the gas valve solenoid 370 or 380) when the water level reaches the float switch 150 and activates it. Thus, the user or the installer may vary the amount of water that leaks or drips from the pressure relief valve before the float switch 150 is activated and the boiler is shut off by varying the size of the container (diameter if cylindrical, for example) to vary the volume of water leaked before the float switch 150 is activated. Details and specifics on the size of the parts and material selection will be calculated in case of a specific task (in terms of water flow and volume). Various mounting means for the float switch 150 are envisioned, such as threading, rails, clamps, snaps, metal collars, screws, bolts, pins, crimps, welding and other connectors or connection means known in the art. Any other attachment means known in the art for connecting water pipes may be used for the attachment of the hollow pipe 120, the float switches, and the other elements of the present invention. The container 250 may itself be mounted to the floor or to the wall of the boiler 15 to ensure proper positioning for collecting the leaking or dripping water.

The diameter of the hollow pipe 120 is preferably ¾" or 1", but other sizes may be utilized depending on the desired application. The preferred length of the hollow pipe 120 is between 4" and 6", but the length may be varied depending on the application, the sizes of the float switches and the desired speed with which the heating system or boiler is shut off. In yet another improvement of the system, device, and method of the present invention, a warning light and/or sound is used to alert the owners to the problem with the pressure relief valve, contemporaneously with shutting off the boiler or the heating system. In this embodiment, a light, preferably an LED or fiber optic light, and/or a sound emitter (such as a speaker or piezo- or electric buzzer) are built into the device 10 of the present invention, together with control electronics 18 and wiring 168 to activate them, and an interior or exterior power source to power them, which is preferably a replaceable battery.

The pressure relief valve is typically mounted on top of the boiler tank. The hollow pipe 120 is mounted into the pressure relief valve 5 with a fitting on one end of the hollow pipe 120 or a threaded top end 124 as illustrated in FIGS. 9-10. If the pressure relief valve 5 and the hollow pipe 120 are directly above the top of the water boiler 15 and there is not sufficient space to clear the top, an adaptor can be used (additional pipes, elbows and/or and bends) to connect the hollow pipe 120 to the pressure relief valve 5, such as the connection illustrated in FIG. 12.

The hollow pipe 120 is preferably made of copper, where the cross-section of the hollow pipe 120 is preferably substantially the same along its entire length. However, the hollow pipe 120 may be made from stainless steel, cast iron, brass, and other materials commonly used for gas or water pipes.

Figure 14:
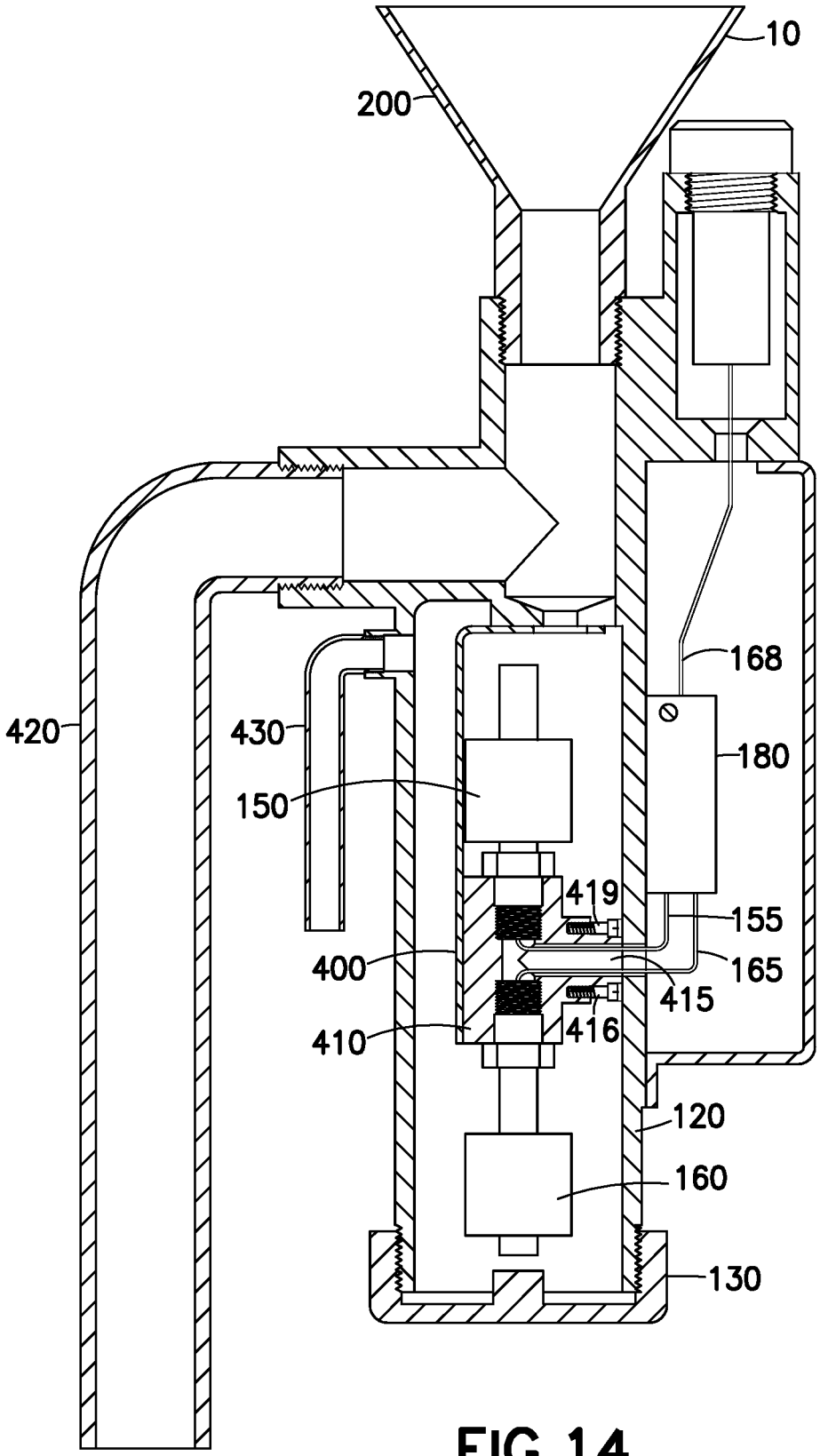
FIG. 14 is a side view of one of the preferred embodiments of the system and device of the present invention.
Figure 15:
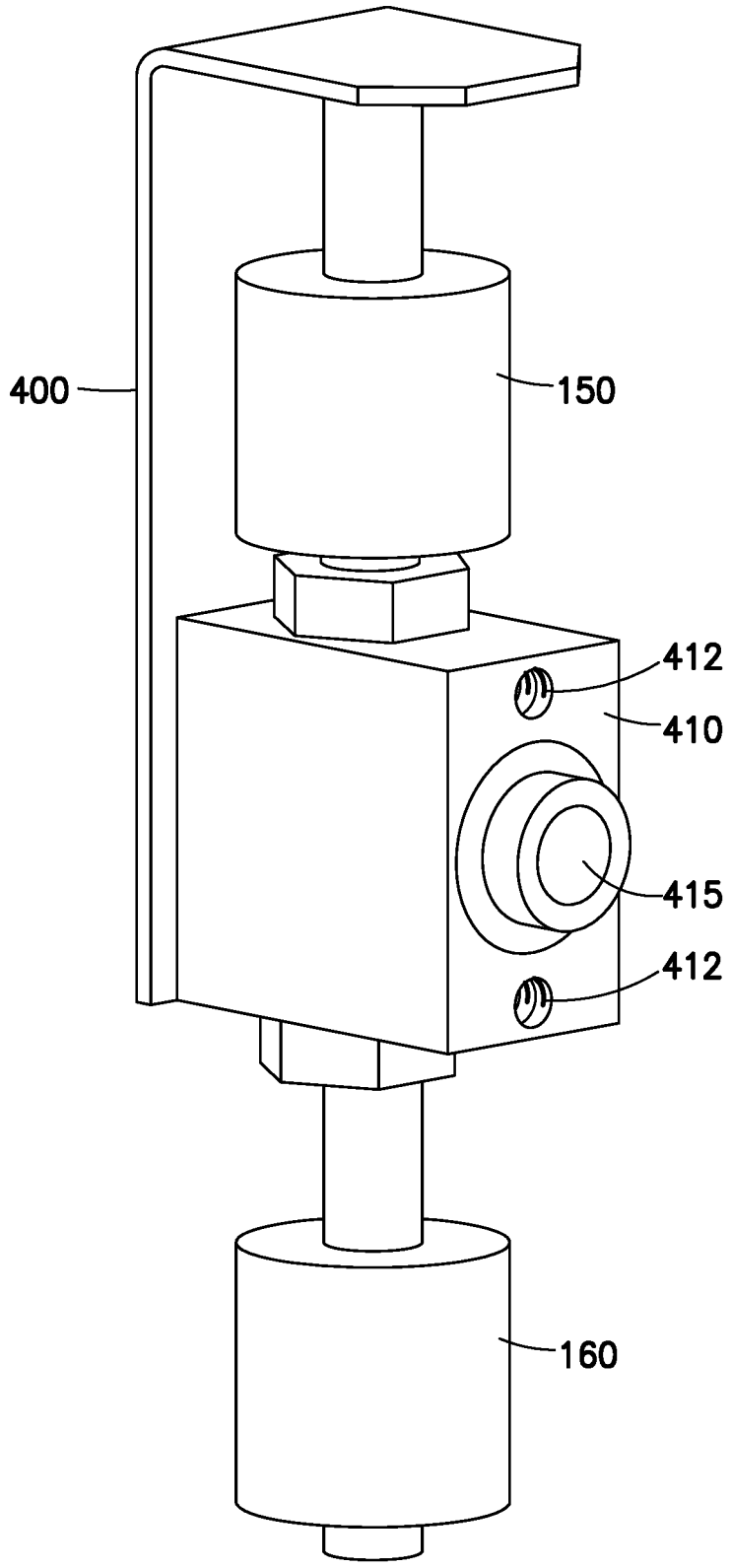
FIG. 15 is an enlarged perspective view of the connector block, protective plate and two connected float switches illustrated in FIG. 14.

With reference to FIGS. 14-15, yet another preferred embodiment of the present invention achieves this goal with a housing in the form of a hollow pipe 120, which is designed for substantially vertical mounting and has a bottom end 122, which is capped or plugged (i.e., does not let water through) or substantially closed (i.e., allow some water through but permits the accumulation of water in the hollow pipe 120), and an open or substantially open top end 124 which is adapted for attaching the housing to the pressure relief valve of a boiler. The hollow pipe 120 is preferably made of copper or other suitable, corrosion-resistant material such as those disclosed herein, and the preferred diameter hollow pipe 120 is one inch (1"), but it could be ¾" to match the standard diameter of the pressure relief valves. Alternatively, the hollow pipe 120 may be 1" but use a ¾" adaptor to connect to the pressure relief valve. It should be noted that although a hollow pipe 120 is the preferred shape of the housing, the housing may be of any other shape or size with an internal cavity. Other attachment means known in the art may be used to connect the open top end 124 to the pressure relief valve of a boiler, including collars, nuts and bolts, screws, pins, clamps, reciprocal connectors, and other methods known in the art.

The bottom end 122 of the hollow pipe 120 is capped with a cap 130 to allow the accumulation of water inside the hollow pipe 120. There may also be a downward-pointed pipe 420 attached to the hollow pipe 120 above the top end 124 to channel excess water away from the device. An additional downward-pointed pipe 430 may be attached to the hollow pipe 120 below the top end 124 to allow the runoff of excess water and/or air from the housing (hollow pipe) 120 itself. Thus, the downward-pointed pipe 430 essentially serves as a water and/or air vent, which can be automatic. Using one or both pipes ensures that no excess pressure builds inside the hollow pipe 120, but still enables sufficient water amounts to be collected for the proper operation of the device.

There is at least one float switch 150 disposed, positioned or mounted inside the hollow pipe 120. The height of the mounting of the float switch 150 inside the hollow pipe 120 determines how early the switch is activated. Although the float switch 150 may be permanently or semi-permanently mounted, it is preferably mounted in a semi-permanent (detachable) way, preferably to the connector block 410, so that the float switch 150 may be easily replaced. The connector block 410 has one or more apertures 412 cooperating in size and positioning with the respective one or more apertures 416 in the hollow pipe 120. For removable mounting, the apertures 412 and 416 are aligned, and the connector block 410 holding the float switch 150 is secured to the hollow pipe 120 by screws 419 of appropriate size. The connector block 410 also preferably has an aperture 415 aligned with the aperture in the hollow pipe 417, through which apertures wiring from the float switch 150 is connected to the terminal block 180. Additionally, the position of the float switch 150 inside the hollow pipe 120 may be adjustable, so that the user or the installer may vary how soon the switch is activated by selectively installing the float switch 150 higher or lower inside the hollow pipe 120. The bracket 210 attached to the hollow pipe 120 secures the device to the wall of a boiler.

The float switch 150 is electrically connected to one of the limit switches of the boiler, as illustrated in FIG. 15, such as by water-resistant or waterproof electrical wiring 155 that passes through apertures 415 in the connector block 410 and 417 in the hollow pipe 120 to connect to the terminal block 180 and from that to reach the limit switch circuit. It should be noted that the runoff pipe 430 should be positioned above the float switch 150 to ensure that the water does not leak out or drip before reaching the float switch 150, as illustrated in FIG. 14. The float switch 150 may be covered by a protective plate 400 to ensure that the float switch 150 is not tripped before sufficient water accumulates in the hollow pipe 120. The protective plate 400 is preferably mounted onto the connector block 410, but it may also be mounted to the hollow pipe 120 or the float switch 150 itself.

In operation, the device should be connected to or positioned under the pressure relief valve 5 (with a funnel 200) the so that the hollow pipe 120 is substantially vertical. The water leaking or dripping from the pressure relief valve 5 will accumulated in the hollow pipe 120 and eventually reach the level of the float switch 150, which will activate and open or close the electrical circuit of the limit switch, and thus will shut off the boiler 15 when the water level reaches the float switch 150 and activates it. Thus, the user or the installer may vary the amount of water that leaks or drips from the pressure relief valve 5 before the float switch 150 is activated and the boiler is shut off.

As illustrated in FIG. 14, there may be two float switches 150 and 160 disposed inside the hollow pipe 120, both connected to the connector block 410. The float switches 150 and 160 are electrically connected to one of the limit switches of the boiler, as illustrated in FIG. 14, such as by water-resistant or waterproof electrical wiring 155 and 165 passing through apertures 415 in the connector block 410 and 417 in the hollow pipe 120 to connect to the terminal block 180. In operation, the bottom float switch 160 may give an early visual and/or audible warning to the operator or owner of the boiler by being electrically connected to the alarm module 10 through electrical wiring through the terminal block 180 as illustrated in FIGS. 14-15. In this and all of the described embodiments, a single float switch 150 with a relay 390 as illustrated in FIGS. 16-17 can perform the same functions as two float switches illustrated in FIGS. 14-15.

Figure 24:
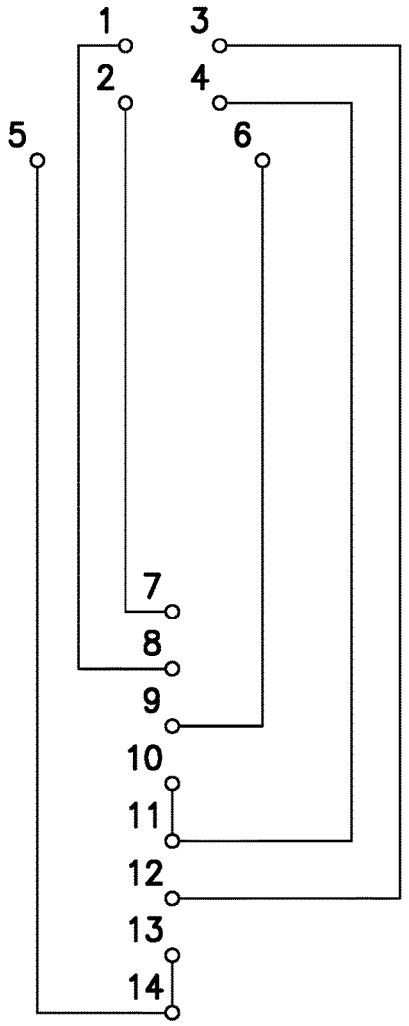
FIG. 24 is an electrical diagram of the printed circuit board and the contacts of an electrical relay of the system and device of the present invention.

The relay can be a single pole single throw or a double pole double throw relay, and the preferred embodiment uses the double pole double throw relay 390 (a single coil-double contact points relay), the printed circuit board and contacts of which are illustrated in FIG. 24. The preferred relay is the double pole double throw relay 390 because it can work with one float switch 150. Note that such a configuration activates the alarm and shuts down the unit/water to the unit at the same time, which will be suitable for most practical uses. However, if it is desirable to provide these functions at different times, two float switches may still be used.

Figure 16:
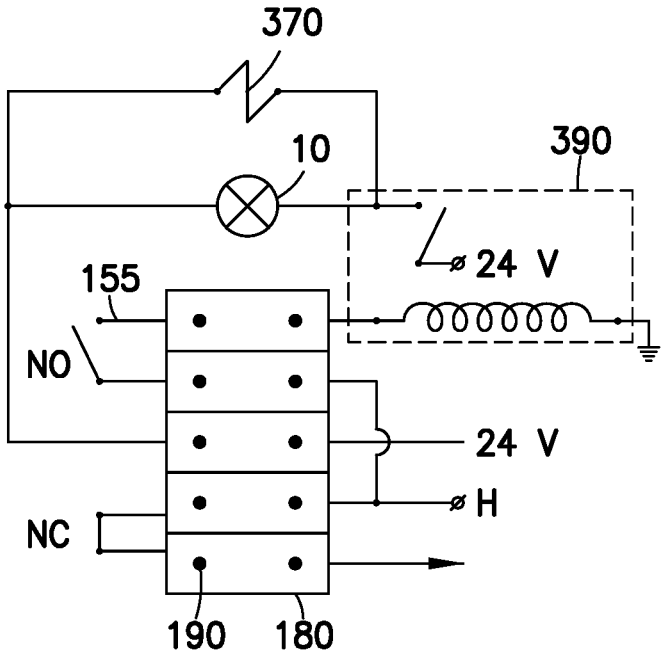
FIG. 16 is an electrical wiring diagram of the preferred embodiment illustrated in FIG. 14.
Figure 17:
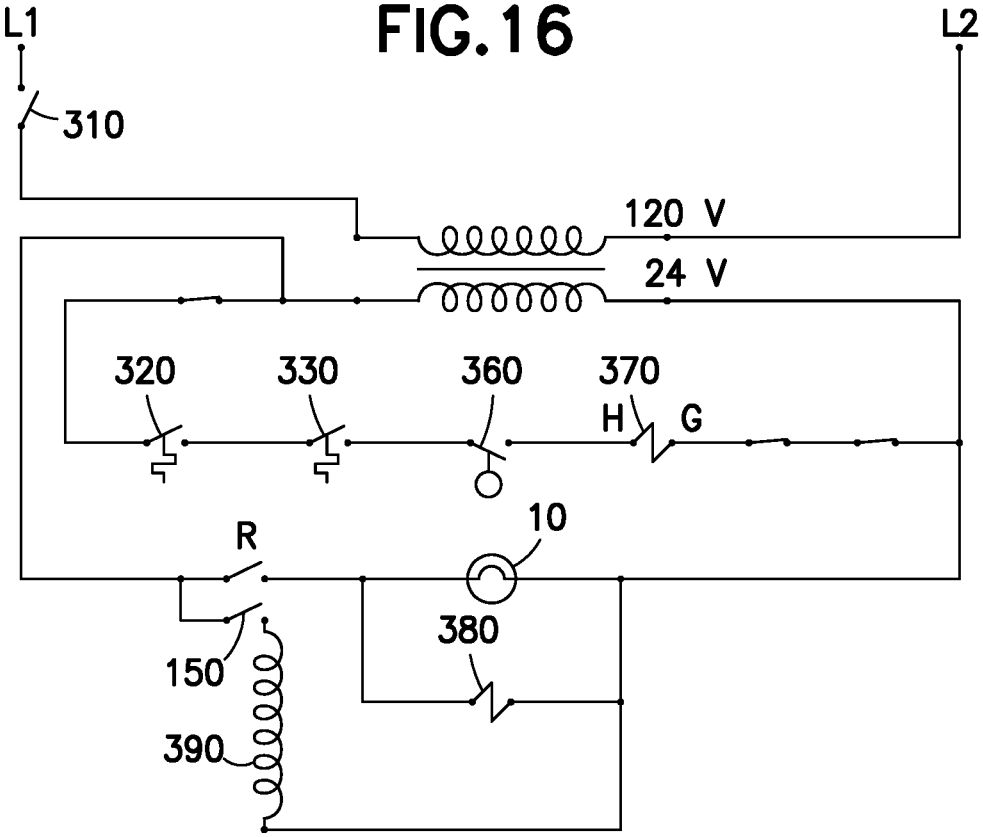
FIG. 17 is another electrical wiring diagram of the preferred embodiment illustrated in FIG. 14.

Specifically with reference to FIGS. 16-17, in operation, the device should be connected to or positioned under the pressure relief valve 5 (with a funnel 200) the so that the hollow pipe 120 is substantially vertical. The water leaking or dripping from the pressure relief valve 5 will accumulated in the hollow pipe 120 and eventually reach the level of the float switch 150, which will activate and open or close the electrical circuit of the limit switch, and thus will shut off the boiler 15 when the water level reaches the float switch 150 and activates it and opens or closes the electrical circuit of the limit switch, and thus will shut off the boiler (preferably by shutting off the gas valve solenoid 370 or 380) when the water level reaches the float switch 150 and activates it.

Figure 18:
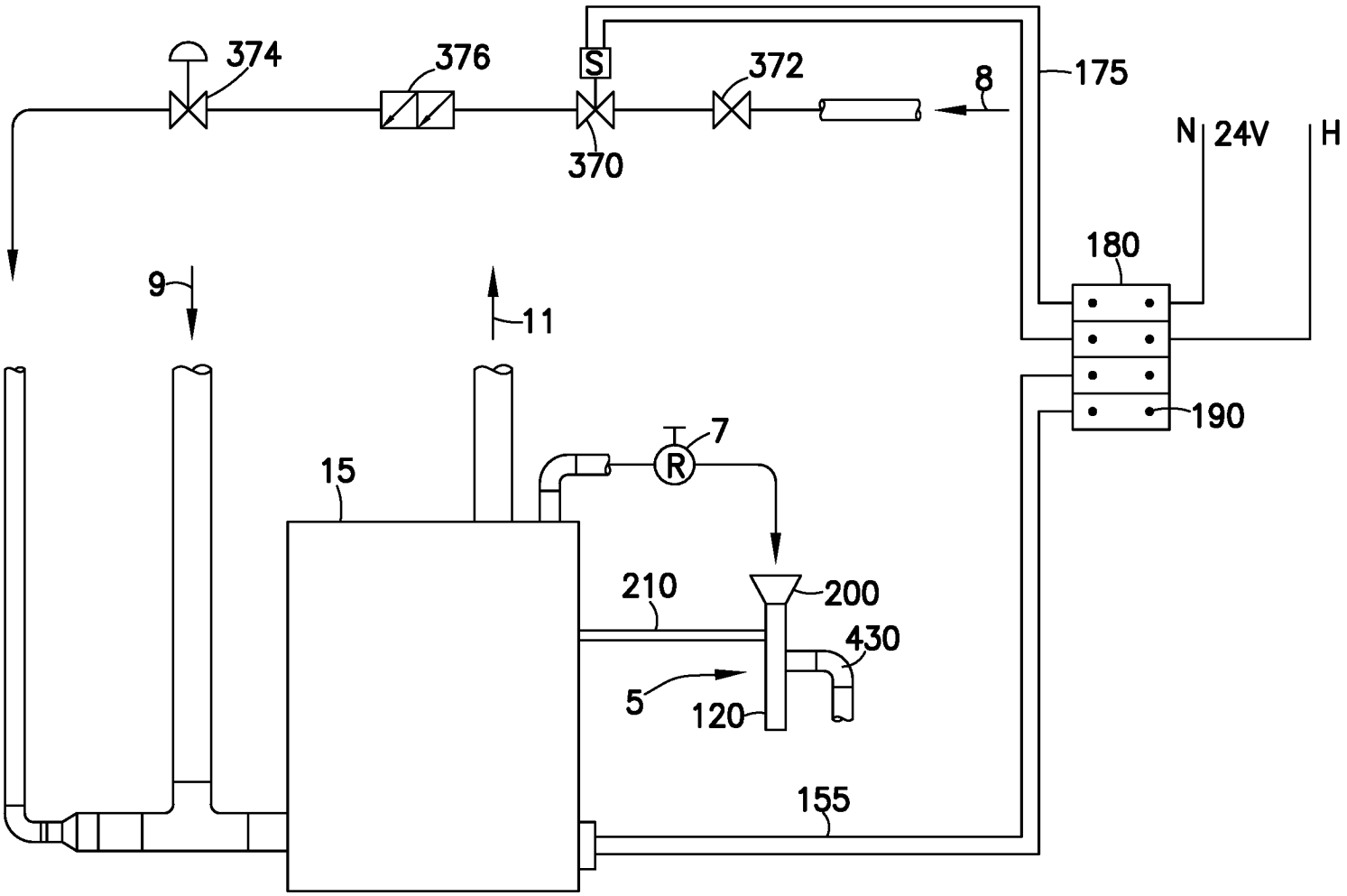
FIG. 18 is a diagram of the system and device of the present invention being used with a hot water boiler.

With reference to FIG. 18, the system and device of the present invention being used with a hot water boiler, the hot water boiler 15 has a city water in pipe 8, a water supply pipe 11, a return pipe 9, a pressure relief valve 7, and electrical wiring 155 (the limits connection) connected to the hot water boiler 15. The system and device of the present invention 5 (Overflow Preventer) is connected to the hot water boiler 15 by a bracket 210. Specifically, the system and device of the present invention 5 include a hollow pipe 120 (housing) with a connected funnel 200 as described in this specification and a downward-pointed pipe 430 connected to the hollow pipe 120. The downward-pointed pipe 430 releases excess water from the hollow pipe 120 to ensure pressure does not build up inside.

The terminal block 180 in the Over flow Preventer is wired to the hot water boiler 15 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 on the city water in pipe 8, a backflow preventer 376 and a pressure regulating valve 374. The size and length of the bracket 210 are selected so as to enable the system and device of the present invention 5 to be positioned substantially under the water runoff from the pressure relief valve 7. In operation, the funnel 200 collects the water runoff and directs it into the hollow pipe 120, where the water activates a float switch or switches, shutting off the solenoid valve 370.

Figure 19:
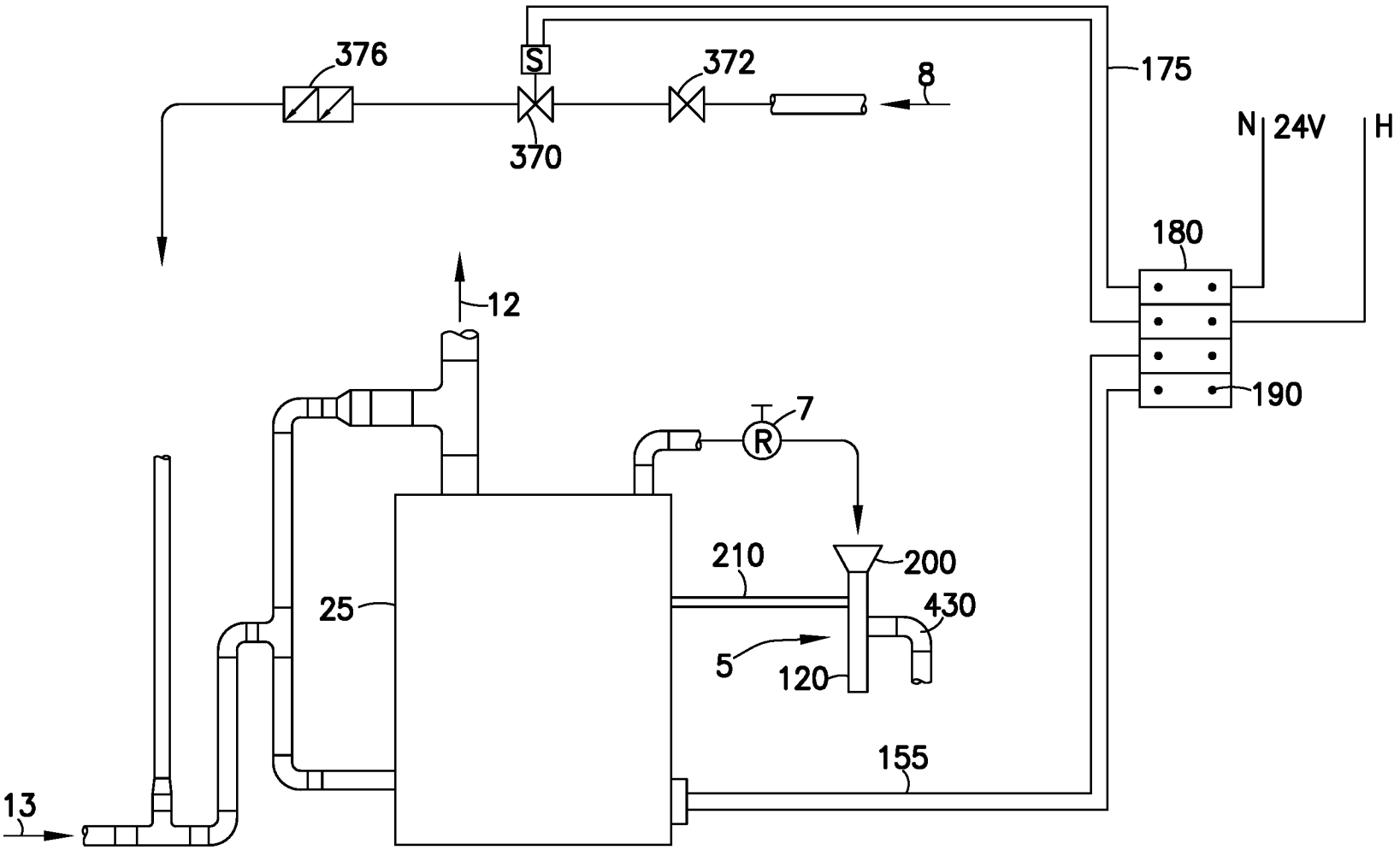
FIG. 19 is a diagram of the system and device of the present invention being used with a steam boiler.

The operation of the system and device 5 of the present invention with a steam boiler is similar. With reference to FIG. 19, the steam boiler 25 has a city water in pipe 8, a steam supply pipe 12, a condensate return pipe 13, a pressure relief valve 7, and electrical wiring 155 (the limits connection) connected to the steam boiler 25. The system and device of the present invention 5 (Overflow Preventer) is connected to the steam boiler 25 by a bracket 210. The system and device of the present invention 5 include a hollow pipe 120 (housing) with a connected funnel 200 as described in this specification and a downward-pointed pipe 430 connected to the hollow pipe 120. The downward-pointed pipe 430 releases excess water from the hollow pipe 120 to ensure pressure does not build up inside.

The terminal block 180 in the Over flow Preventer is wired to the steam boiler 25 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 on the city water in pipe 8 and a backflow preventer 376. The size and length of the bracket 210 are selected so as to enable the system and device of the present invention 5 to be positioned substantially under the water runoff from the pressure relief valve 7. In operation, the funnel 200 collects the condensed water from the steam exiting the pressure relief valve 7 on a steam boiler 25 and directs it into the hollow pipe 120, where the water activates a float switch or switches, shutting off the solenoid valve 370.

Figure 20:
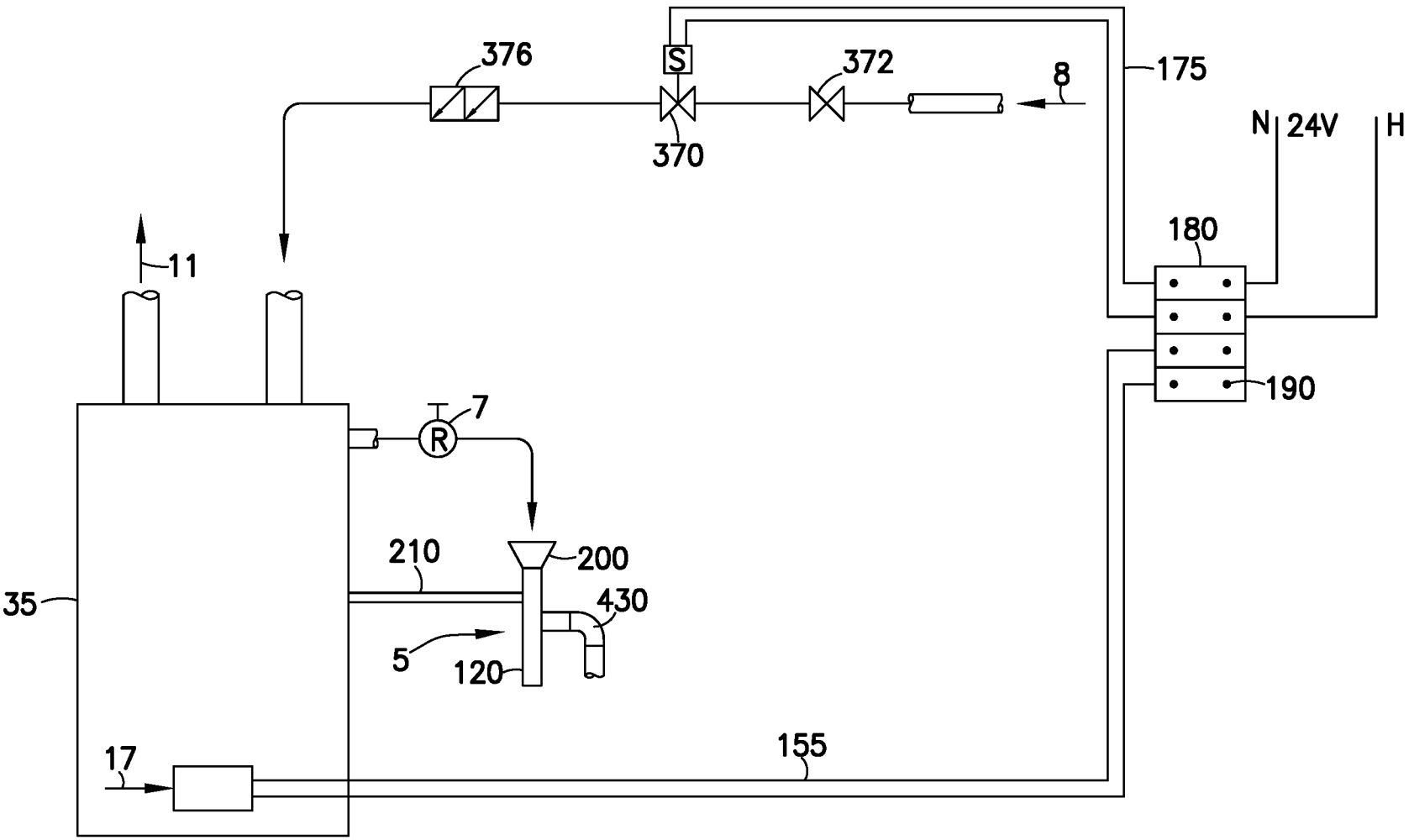
FIG. 20 is a diagram of the system and device of the present invention being used with a hot water tank.

FIG. 20 illustrates the operation of the system and device 5 of the present invention with a hot water tank. With reference to FIG. 20, the hot water tank 35 has a city water in pipe 8, a hot water supply pipe 11, a burner assembly 17, a pressure relief valve 7, and electrical wiring 155 (the limits connection) connected to the hot water tank 35. The system and device of the present invention 5 (Overflow Preventer) is connected to the hot water tank 35 by a bracket 210. The system and device of the present invention 5 include a hollow pipe 120 (housing) with a connected funnel 200 as described in this specification and a downward-pointed pipe 430 connected to the hollow pipe 120. The downward-pointed pipe 430 releases excess water from the hollow pipe 120 to ensure pressure does not build up inside.

The terminal block 180 in the Over flow Preventer is wired to the hot water tank 35 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 on the city water in pipe 8. The size and length of the bracket 210 are selected so as to enable the system and device of the present invention 5 to be positioned substantially under the water runoff from the pressure relief valve 7. In operation, the funnel 200 collects the water runoff and directs it into the hollow pipe 120, where the water activates a float switch or switches, shutting off the solenoid valve 370 and/or the burner assembly 17.

Figure 21:
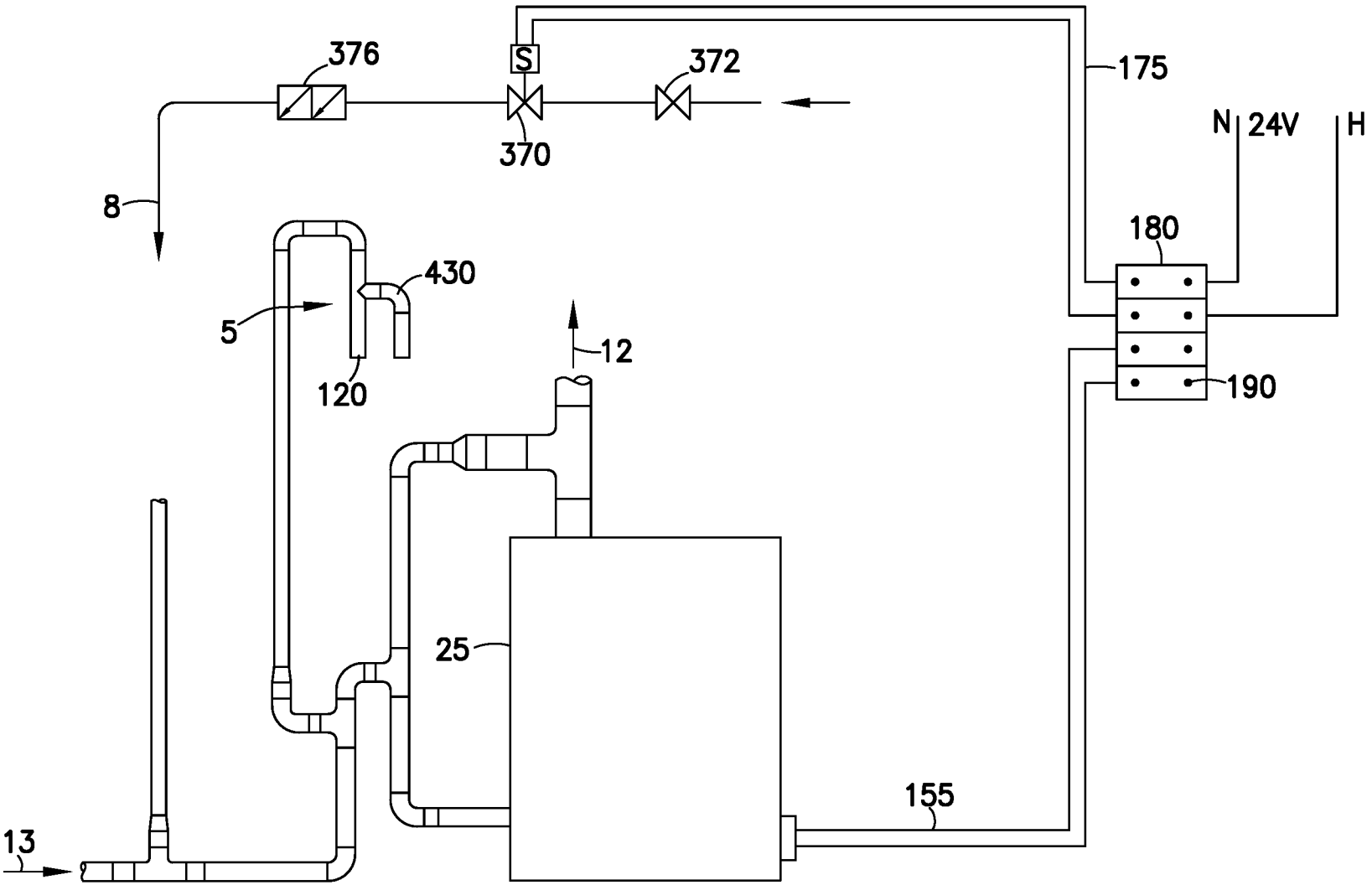
FIG. 21 is a diagram of the system and device of the present invention being used on a steam boiler return.

A secondary or standalone Overflow Preventer may be configured on a steam boiler return. With reference to FIG. 21, the steam boiler 25 has a city water in pipe 8, a steam supply pipe 12, a condensate return pipe 13, and electrical wiring 155 (the limits connection) connected to the steam boiler 25. The system and device of the present invention 5 (Overflow Preventer) is connected to the condensate return pipe 13 of the steam boiler 25 as shown and as described in this specification. The system and device of the present invention 5 include a hollow pipe 120 (housing), which is directly connected to the condensate return pipe 13, and a downward-pointed pipe 430 connected to the hollow pipe 120. The downward-pointed pipe 430 releases excess condensed water from the hollow pipe 120 to ensure pressure does not build up inside.

The terminal block 180 in the Over flow Preventer is wired to the steam boiler 25 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 and a backflow preventer 376. In operation, the hollow pipe 120 collects the condensed water from the steam exiting condensate return pipe 13 on the steam boiler 25, where (in the hollow pipe 120) the water activates a float switch or switches, shutting off the solenoid valve 370.

Figure 22:
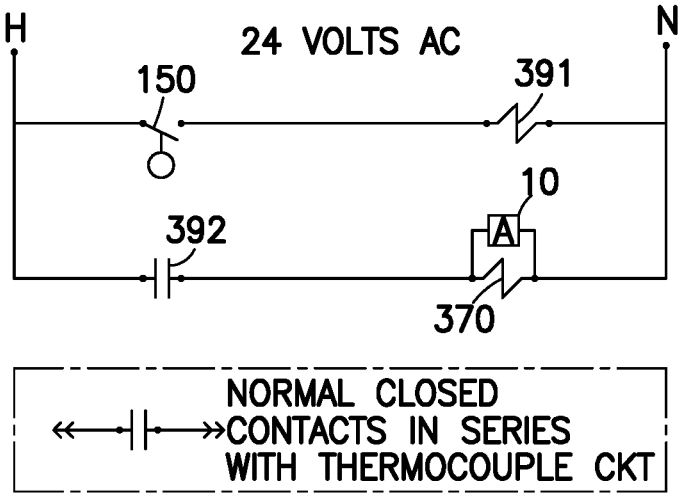
FIG. 22 is an electrical schematic of the system and device of the present invention being used with a hot water tank.

With reference to FIGS. 22 and 24, an electrical schematic of the system and device of the present invention being used with a hot water tank as shown in FIG. 20 and the relay printed circuit board (PCB) is shown as follows: a float switch 150 is electrically connected with a relay solenoid 391 in series, and they are connected in parallel to the hot and neutral 24 V power supply from a transformer and a combination of relay contacts 392 electrically connected with a solenoid valve 370 in series. An alarm module 10 is preferably also connected in parallel with the solenoid valve 370. The relay contacts 392 are normally closed contacts, electrically connected in series with a thermocouple (temperature sensing) circuit. The normally closed relay contacts 392 allow the system to operate normally. If any system over pressurizes, the system and device of the present invention 5 (Overflow Preventer) accumulates water until the float switch 150 closes and energizes the relay coil. When the relay coil is energized, it opens normally closed contacts and closes the normally open contacts. Opening the normally closed relay contacts 392 shuts down the unit (boiler, water tank, etc.), usually by opening the contacts on limit switches and shutting off the burners of the unit, and closing the normally open contacts activates the solenoid valve 370 to shut off the water supply and/or alarm module 10 (audible alarm, lights, and/or wireless communication to the owner/operator of the unit).

Specifically with reference to FIG. 24, the contacts of the PCB are 1-2 (normally closed contacts to limits in series with the limits), 3-4 (normally open contacts in series with the solenoid valve 370 and/or alarm module 10, 5-6 (the relay coil terminals), 7-8 (the limits), 9-10 (the float switch 150), 11 (24 V hot electric power), 12-13 (solenoid valve 370 and/or alarm module 10), and 14 (24 V neutral).

Figure 23:
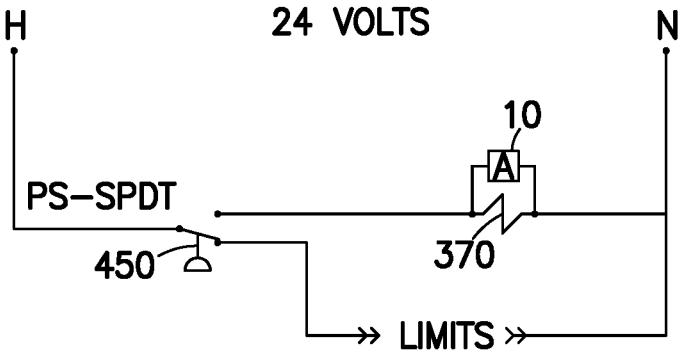
FIG. 23 is an electrical schematic of the system and device of the present invention being used with a hot water boiler.

Although the preferred and alternative embodiments previously described use float switches to illustrate the operation of the system and device of the present invention, all of the embodiments may be assembled and used with an air pressure switch instead of a float switch. For example, with reference to FIG. 23, which is an electrical schematic of the system and device of the present invention being used with a hot water boiler, a pressure switch 450 (single pole double throw) is electrically connected in series with the limits of the boiler unit and connected to the hot and neutral 24 V power. When the pressure switch 450 is activated, it opens the limits connection, which in turn deactivates the burner unit of the boiler, effectively shutting it down, and closes the circuit with the solenoid valve 370 (in series), which forces the solenoid valve to shut off the water supply to the unit. Again, an alarm module 10 may be connected in parallel with the solenoid valve 370 to provide audio, visual, and wireless notification to the owner/operator of the unit.

Although not necessary to the operation of the system and device of the present invention, to improve the safety of heating systems, boilers and steam boilers burning natural gas, the system and device may include electrical and/or electronic control and/or monitoring circuits and mechanisms, monitoring the water flow through the pipe, using various optical, electrical, mechanical, and other sensors positions in or about the system and device.

In an alternative embodiment, the system and device may include a controller or a programmable controller to further improve the efficiency of the system and device of the present invention. Such a controller may include a number of programs and/or settings that take into consideration the communications and warnings/alarms to the operator or owner via the alarm module or other communication means such as telephone or Wi-Fi. The controller may be an independent computer, a chip-based controller, or a different controller known in the art.

These configurations will enable the system and device disclosed in the specification of the present invention to improve the safety of the heating systems and boilers in any gas-burning system or device.

Anyone can use the system and device of the present invention to improve the safety of boilers and steam boilers, providing additional safety, cost savings, and other benefits of safer, more efficient operation. The dimensioning and sizing of the system and device of the present invention to improve the safety of boilers and steam boilers burning natural gas (i.e., the sizing and shapes of the pipes, fittings, threading, and housings) may be easily determined by those skilled in the art, but the applicant envisions that the system and device may be made with varying sizes, height/length, width/diameter, and other parameters.

While the system and device to improve the safety of boilers and steam boilers burning natural gas of the present invention have been shown and described in accordance with the preferred and practical embodiments thereof, it is recognized that departures from the instant disclosure are contemplated within the spirit and scope of the present invention. Therefore, the true scope of the invention should not be limited by the abovementioned description of the preferred embodiments since other modifications may become apparent to those skilled in the art upon a study of the drawings, description, explanations, and specifications herein. Various modifications to these embodiments will be readily apparent to those skilled in the art, and the principles described herein can be applied to other embodiments without departing from the spirit or scope of the invention and the subject matter of the present invention.

What is claimed is:

1. A boiler overflow preventer system, comprising:

a. a housing having a top end connected to a first in-line arm of a first fluid Tee joint, also having a second in-line arm and a transverse arm, a bottom end removably capped with a cap, and an internal cavity between the top end and the bottom end in fluid communication with the second in-line arm, said second in-line arm being adapted to be to removably connected to a pressure relief valve of a boiler, with an aperture in the housing allowing access to the internal cavity for electrical wiring;

b. a cooperating core for insertion into the internal cavity, said cooperating core having a first open end and a second open end and at least one aperture therebetween for the electrical wiring;

c. a plurality of float switches or air pressure switches mounted in the cooperating core between the first open end and the second open end, said plurality of float switches or air pressure switches being electrically connected to at least one limit switch of a boiler by the electrical wiring passing through the aperture in the housing and through the at least one aperture in the cooperating core when the cooperating core is inserted into the internal cavity and the bottom end of the housing is capped with the cap;

d. a second Tee joint having a transverse arm connected to the transverse arm of the first fluid Tee joint; and e. an alarm module connected to an upward in-line arm of the second Tee joint and in electrical communication with the plurality of float switches or air pressure switches, wherein the water from the pressure relief valve accumulates in the internal cavity of the housing through the second in-line arm and fills the cooperating core therein, activating the plurality of float switches or air pressure switches mounted in the cooperating core when the water reaches the plurality of float switches or when the air pressure builds up in the internal cavity and opening or closing an electrical circuit connected to the at least one limit switch and, wherein excess water is discharged from the housing through a downward in-line arm of the second Tee joint opposite to the upward in-line arm.

2. The boiler overflow preventer device of claim 1, further comprising a terminal block for connecting the electrical wiring from the plurality of float switches or air pressure switches to the at least one limit switch, said terminal block being mounted exteriorly to the housing and having a plurality of terminal block screws for selectively connecting the electrical wiring from the plurality of float switches or air pressure switches to the at least one limit switch.

3. The boiler overflow preventer device of claim 1, wherein the alarm module includes two or more of a visual alarm, an audio alarm, a telephone communication alarm, a text alarm, an email communication alarm, a data alarm, and a network communication alarm.

4. The boiler overflow preventer device of claim 1, further comprising a plurality of protective plates, each of the plurality of the protective plates being operatively positioned above a respective each of the plurality of float switches or air pressure switches so as to permit the accumulation of water in the housing but prevent premature activation of each of the plurality of float switches or air pressure switches.

5. The boiler overflow preventer device of claim 1, further comprising an alarm module housing mounted exteriorly to the housing and encasing the alarm module.

6. The boiler overflow preventer device of claim 1, wherein a first float switch or air pressure switch of the plurality of float switches or air pressure switches performs a first function.

7. The boiler overflow preventer device of claim 6, wherein the first function is activating an alarm when the water accumulates in the housing.

8. The boiler overflow preventer device of claim 1, wherein a second float switch or air pressure switch of the plurality of float switches or air pressure switches performs the opening or closing the electrical circuit connected to the at least one limit switch when the water accumulates in the housing.

9. The boiler overflow preventer device of claim 8, wherein the opening or closing the electrical circuit shuts off the boiler gas valve.

10. The boiler overflow preventer device of claim 1, wherein the second in-line arm is removably connected to the pressure relief valve of a boiler for collecting the water into the housing.

11. The boiler overflow preventer device of claim 1, wherein the plurality of float switches or air pressure switches is a plurality of float switches, further comprising a cooperating funnel having a spout removably connected to the second in-line arm and a throat for collecting the water into the housing from the pressure relief valve and further comprising a bracket for connecting the housing to a wall or a boiler so that the cooperating funnel is positioned substantially under the pressure relief valve of the boiler when the housing is so mounted.

12. The boiler overflow preventer device of claim 1, further comprising a connector block for mounting the plurality of float switches or air pressure switches, said connector block having a first aperture for electrical wiring and a second aperture for mounting the connector block in the cooperating core between the first open end and the second open end, wherein the first aperture is substantially aligned with the at least one aperture for passage of the electrical wiring when the connector block is mounted in the cooperating core.

13. The boiler overflow preventer device of claim 2, wherein the alarm module is electrically connected to the terminal block, enabling the electrical communication of the alarm module with the plurality of float switches or air pressure switches.

14. The boiler overflow preventer device of claim 1, further comprising a cooperating grommet mounted in the aperture to form a water-resistant seal around the electrical wiring.

15. The boiler overflow preventer device of claim 1, wherein water detection inside the housing comprises activating at least one float switch or air pressure switch of the plurality of float switches or air pressure switches and opening or closing the electrical circuit connected to the limit switch.

16. The boiler overflow preventer device of claim 1, wherein the plurality of float switches or air pressure switches is not magnetic.

17. The boiler overflow preventer device of claim 1, wherein the plurality of float switches or air pressure switches includes a first float switch or air pressure switch with a first activating function and a second float switch or air pressure switch with a second activating function.

18. The boiler overflow preventer device of claim 17, wherein the first activating function is shutting off a boiler gas valve when the water accumulates in the housing and triggers the first float switch.

19. The boiler overflow preventer device of claim 18, wherein the second activating function is activating an alarm when the water accumulates in the housing and triggers the second float switch.

20. A boiler overflow preventer system, comprising:

a. a housing having a top end connected to a downward in-line arm of a fluid Tee joint, said fluid Tee joint also having an upward in-line arm adapted to be to removably connected to a pressure relief valve of a boiler and a transverse arm connected to a first downward pipe, said first downward pipe discharging excess water from the pressure relief valve, a bottom end capped with a removable cap, and an internal cavity between the top end and the bottom end in fluid communication with the upward in-line arm through the downward in-line arm, with an aperture in the housing allowing access to the internal cavity for electrical wiring;

b. a terminal block mounted exteriorly to the housing;

c. a plurality of float switches or air pressure switches mounted in the internal cavity between the top end and the bottom end, each of said plurality of float switches or air pressure switches being electrically connected to at least one limit switch of a boiler by electrical wiring passing through the aperture in the housing and connecting to the terminal block, said terminal block being electrically connected to the at least one limit switch;

d. a connector block for mounting the plurality of float switches or air pressure switches in the internal cavity, said connector block having a first aperture for electrical wiring and a second aperture for mounting the connector block in the internal cavity between the top end and the bottom end, wherein the first aperture is substantially aligned with the aperture for passage of the electrical wiring when the connector block is mounted in the internal cavity;

e. a second downward pipe connected to the housing between the top end and a top of an uppermost one of the plurality of float switches or air pressure switches in an activated position, said second downward pipe being in fluid communication with the internal cavity; and f. an alarm module mounted exteriorly to the housing and electrically connected to the terminal block, wherein part of the water from the pressure relief valve that is not discharged through the first downward pipe accumulates in the internal cavity through the downward in-line arm and fills the housing, activating the plurality of float switches or air pressure switches mounted in the internal cavity when the water reaches the plurality of float switches or when the air pressure builds up in the internal cavity and opening or closing the electrical circuit of the at least one limit switch, and wherein excess air and water are discharged from the housing through the second downward pipe.

* * * * *